US008380105B2

(12) United States Patent
Kakuta et al.

(10) Patent No.: US 8,380,105 B2
(45) Date of Patent: Feb. 19, 2013

(54) DEVELOPING DEVICE, PROCESS CARTRIDGE, AND ELECTROPHOTOGRAPHIC IMAGE FORMING APPARATUS

(75) Inventors: Hideki Kakuta, Suntou-gun (JP); Tetsuo Furukawa, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/480,560

(22) Filed: May 25, 2012

(65) Prior Publication Data

US 2012/0251159 A1 Oct. 4, 2012

Related U.S. Application Data

(62) Division of application No. 12/468,623, filed on May 19, 2009, now Pat. No. 8,208,838.

(30) Foreign Application Priority Data

May 27, 2008 (JP) ..... 2008-138041
Apr. 28, 2009 (JP) ..... 2009-109390

(51) Int. Cl.
*G03G 15/08* (2006.01)

(52) U.S. Cl. ..... 399/111; 399/27; 399/262

(58) Field of Classification Search ..... 399/27, 399/111, 262, 263
See application file for complete search history.

(56) References Cited

U.S. PATENT DOCUMENTS

| | | | | |
|---|---|---|---|---|
| 5,568,237 | A | 10/1996 | Ishida et al. | |
| 5,612,770 | A | 3/1997 | Bandai et al. | |
| 6,337,956 | B1 | 1/2002 | Sato et al. | |
| 6,456,810 | B1 | 9/2002 | Deguchi et al. | |
| 7,072,594 | B2 | 7/2006 | Hoshi et al. | |
| 7,899,367 | B2 * | 3/2011 | Fukuta | 399/254 |
| 2007/0092286 | A1 * | 4/2007 | Suzuki et al. | 399/90 |
| 2008/0292331 | A1 * | 11/2008 | Yokomori et al. | 399/27 |
| 2009/0297175 | A1 | 12/2009 | Kakuta et al. | |

FOREIGN PATENT DOCUMENTS

| | | |
|---|---|---|
| JP | 4-97179 | 3/1992 |
| JP | 8-123178 | 5/1996 |
| JP | 2003-131479 | 5/2003 |
| JP | 3673795 | 7/2005 |

OTHER PUBLICATIONS

Office Action in Chinese Patent Application No. 200910145642.X, dated May 5, 2011 (with English translation).

* cited by examiner

*Primary Examiner* — David Gray
*Assistant Examiner* — G. M. Hyder
(74) *Attorney, Agent, or Firm* — Fitzpatrick, Cella, Harper & Scinto

(57) ABSTRACT

In a developing device, a rotation shaft is provided with a developer feeding member, a cleaning member, and a receiving portion. The receiving portion is provided downstream of the developer feeding member and upstream of a light transmitting member, provided to a wall surface of a developer accommodating chamber of the developing device, with respect to a rotational direction of the rotation shaft when the cleaning member has passed through the light transmitting member.

24 Claims, 13 Drawing Sheets

(a)

A-A (b)

(a)

(b)

(a)

(b)

(a)

(b)

(a)

(b)

(a)

(b)

(a)

(b)

DEVELOPING DEVICE, PROCESS CARTRIDGE, AND ELECTROPHOTOGRAPHIC IMAGE FORMING APPARATUS

This application is a divisional of application Ser. No. 12/468,623, filed May 19, 2009.

FIELD OF THE INVENTION AND RELATED ART

The present invention relates to an electrophotographic image forming apparatus, a developing device for use with the electrophotographic image forming apparatus, and a process cartridge detachably mountable to the electrophotographic image forming apparatus.

The electrophotographic image forming apparatus forms an image on a recording material by using an electrophotographic image forming system. Examples of the electrophotographic image forming apparatus may include, e.g., an electrophotographic copying machine, an electrophotographic printer (a laser beam printer, an LED printer, etc.), a facsimile machine, a word processor, and the like.

The developing device is a device for visualizing an electrostatic latent image on an image bearing member such as an electrophotographic photosensitive member by using developer.

The process cartridge is a cartridge which is prepared by integrally supporting a charging means, a developing means or a cleaning means together with the image bearing member and which is detachably mountable to a main assembly of the electrophotographic image forming apparatus. Further, the process cartridge refers to a cartridge which is prepared by integrally supporting at least the charging means and the image bearing member and which is detachably mountable to the apparatus main assembly.

In a conventional electrophotographic image forming apparatus using an electrophotographic image forming process, the electrophotographic photosensitive member and process means acting thereon are integrally supported to prepare a cartridge. Further, the electrophotographic image forming apparatus is a process cartridge type apparatus in which the cartridge is detachably mountable to the main assembly of the electrophotographic image forming apparatus. According to this process cartridge type apparatus, maintenance of the apparatus can be performed by a user by himself (herself) without relying on a service person, so that it is possible to remarkably improve operability.

One of the conditions requiring exchange of the process cartridge, is a shortage of developer. Recently, detection of the remaining developer amount has been carried out by various methods in order to notify the user of remaining developer amount information to urge the user to exchange the process cartridge smoothly.

As one of the methods, there is light transmission-type remaining developer amount detection (Japanese Laid-Open Patent Application (JP-A)2003-131479; FIG. 8). In JP-A 2003-131479, detection light emitted from a light emitting portion such as an LED mounted to a main assembly of an image forming apparatus is introduced into a developer accommodating container through a light guide and a light transmitting window which are mounted to the image forming apparatus or a process cartridge.

The detection light entering the inside of the developer accommodating container passes through the light transmitting window or the like (or a reflecting mirror as another example) to travel to the outside of the developer accommodating container. Thereafter, the detection light is guided to a light receiving portion such as a phototransistor mounted to the image forming apparatus main assembly through a light guide mounted to the image forming apparatus main assembly or the developer accommodating container.

Generally, inside the developer accommodating container, a rotatably supported developer feeding member is provided in order to feed the developer in a developing roller direction while stirring the developer. The detection light is blocked by rotation of the developer feeding member and the developer. Further, with a smaller remaining developer amount, the transmission time of light becomes longer. In such a manner, the transmission time of the detection light is detected, so that the remaining developer amount in the developer accommodating container can be estimated. The above-described method is the light transmission-type remaining developer amount detection.

Further, in the light transmission-type remaining developer amount detection, in order to improve detection accuracy, two developer feeding members are provided to a single rotation shaft (Japanese Patent No. 03673795; FIG. 1) or a developer feeding member and a cleaning member are provided to a single rotation shaft (JP-A Hei 4-97179; FIG. 1).

However, in the conventional remaining developer amount detection, with high-speed printing on a large number of sheets, the developer is fed by rotating the developer feeding member at high speed or by utilizing a restoring force of a flexible developer feeding member as described later in an embodiment of the present invention, and as a result, the developer can scatter in the developer accommodating container. The scattering of the developer may be attributable to vigorous falling of the developer scooped up by the developer feeding member from the developer feeding member or the presence of an air current during elimination of deformation of a flexible sheet. When the developer in the developer accommodating container is scattered, the scattered developer blocks the detection light, so that the scattered developer adversely affects the detection accuracy in the light transmission-type remaining developer detection in some cases.

SUMMARY OF THE INVENTION

A principal object of the present invention is to provide a developing device having improved accuracy of the light transmission-type remaining developer amount even in the case where a developer feeding member is rotated at high speed or in the case where developer is fed by a restoring force of the developer feeding member.

Another object of the present invention is to provide a process cartridge and an electrophotographic image forming apparatus which include the developing device.

According to an aspect of the present invention, there is provided a developing device for use with an electrophotographic image forming apparatus, comprising:

a developer carrying member for developing an electrostatic latent image formed on an electrophotographic photosensitive member with developer;

a developer chamber provided with the developer carrying member;

a developer accommodating chamber that accommodates, the developer to be supplied into the developer chamber; and includes a bottom surface and a wall surface separating the developer accommodating chamber and the developer chamber and having an opening for permitting passing of the developer therethrough;

a rotation shaft rotatably supported in the developer accommodating chamber; and a light transmitting member, mounted to the wall surface of the developer accommodating chamber at a position upstream of the opening and downstream of the bottom surface with respect to a rotational direction of the rotation shaft, that passes detection light through an inside of the developer accommodating chamber in order to detect an amount of the developer in the developer accommodating chamber, wherein the rotation shaft includes:

a developer feeding member, which has flexibility and is mounted to the rotation shaft at one end thereof with respect to a direction of radius of gyration of said rotation shaft, to feed the developer while deforming in contact with an inner wall of the developer accommodating chamber at the other end thereof by rotation of the rotation shaft;

a cleaning member, provided upstream of the developer feeding member with respect to the rotational direction of the rotation shaft, to slide on the light transmitting member by the rotation of the rotation shaft; and a receiving portion that receives the developer falling from the developer feeding member by the rotation of the rotation shaft.

According to another aspect of the present invention, there is provided a process cartridge detachably mountable to a main assembly of an electrophotographic image forming apparatus, comprising:

an electrophotographic image forming apparatus;

a developer carrying member that develops an electrostatic latent image formed on the electrophotographic photosensitive member with developer;

a developer chamber provided with the developer carrying member;

a developer accommodating chamber, provided separately from the developer chamber by a wall surface thereof provided with an opening for permitting passing of the developer therethrough, for accommodating the developer to be supplied into the developer chamber;

a rotation shaft rotatably supported in the developer accommodating chamber; and a light transmitting member, mounted to the wall surface of the developer accommodating chamber at a position upstream of the opening and downstream of a bottom which forms the developer accommodating chamber with respect to a rotational direction of the rotation shaft, for passing detection light through an inside of the developer accommodating chamber in order to detect an amount of the developer in the developer accommodating chamber, wherein the rotation shaft includes:

a developer feeding member, which has flexibility and is mounted to the rotation shaft at one end thereof with respect to a direction of radius of gyration of said rotation shaft, for feeding the developer while deforming in contact with an inner wall of the developer accommodating chamber at the other end thereof by rotation of the rotation shaft;

a cleaning member, provided upstream of the developer feeding member with respect to the rotational direction of the rotation shaft, for sliding on the light transmitting member by the rotation of the rotation shaft; and a receiving portion for receiving the developer falling from the developer feeding member by the rotation of the rotation shaft.

According to another aspect of the present invention, there is provided an electrophotographic image forming apparatus for forming an image on a recording material, comprising:

(i) an electrophotographic image forming apparatus;

(ii) a developing device comprising:

a developer carrying member for developing an electrostatic latent image formed on an electrophotographic photosensitive member with developer;

a developer chamber provided with the developer carrying member;

a developer accommodating chamber, provided separately from the developer chamber by a wall surface thereof provided with an opening for permitting passing of the developer therethrough, for accommodating the developer to be supplied into the developer chamber;

a rotation shaft rotatably supported in the developer accommodating chamber; and a light transmitting member, mounted to the wall surface of the developer accommodating chamber at a position upstream of the opening and downstream of a bottom which forms the developer accommodating chamber with respect to a rotational direction of the rotation shaft, for passing detection light through an inside of the developer accommodating chamber in order to detect an amount of the developer in the developer accommodating chamber, wherein the rotation shaft includes:

a developer feeding member, which has flexibility and is mounted to the rotation shaft at one end thereof with respect to a direction of radius of gyration of said rotation shaft, for feeding the developer while deforming in contact with an inner wall of the developer accommodating chamber at the other end thereof by rotation of the rotation shaft;

a cleaning member, provided upstream of the developer feeding member with respect to the rotational direction of the rotation shaft, for sliding on the light transmitting member by the rotation of the rotation shaft; and a receiving portion for receiving the developer falling from the developer feeding member by the rotation of the rotation shaft; and (iii) feeding means for feeding the recording material.

According to another aspect of the present invention, there is provided an electrophotographic image forming apparatus for forming an image on a recording material, comprising:

(i) mounting means;

(ii) a process cartridge detachably mountable to the mounting means, comprising:

an electrophotographic image forming apparatus;

a developer carrying member for developing an electrostatic latent image formed on the electrophotographic photosensitive member with developer;

a developer chamber provided with the developer carrying member;

a developer accommodating chamber, provided separately from the developer chamber by a wall surface thereof provided with an opening for permitting passing of the developer therethrough, for accommodating the developer to be supplied into the developer chamber;

a rotation shaft rotatably supported in the developer accommodating chamber; and a light transmitting member, mounted to the wall surface of the developer accommodating chamber at a position upstream of the opening and downstream of a bottom which forms the developer accommodating chamber with respect to a rotational direction of the rotation shaft, for passing detection light through an inside of the developer accommodating chamber in order to detect an amount of the developer in the developer accommodating chamber, wherein the rotation shaft includes:

a developer feeding member, which has flexibility and is mounted to the rotation shaft at one end thereof with respect to a direction of radius of gyration of said rotation shaft, for feeding the developer while deforming in contact with an inner wall of the developer accommodating chamber at the other end thereof by rotation of the rotation shaft;

a cleaning member, provided upstream of the developer feeding member with respect to the rotational direction of the rotation shaft, for sliding on the light transmitting member by the rotation of the rotation shaft; and a receiving portion for receiving the developer falling from the developer feeding member by the rotation of the rotation shaft; and (iii) feeding means for feeding the recording material.

According to another aspect of the present invention, there is provided a developing device for use with an electrophotographic image forming apparatus, comprising:

a developer carrying member for developing an electrostatic latent image formed on an electrophotographic photosensitive member with developer;

a developer chamber provided with the developer carrying member;

a developer accommodating chamber, provided separately from the developer chamber by a wall surface thereof provided with an opening for permitting passing of the developer therethrough, for accommodating the developer to be supplied into the developer chamber;

a rotation shaft rotatably supported in the developer accommodating chamber; and a light transmitting member, mounted to the wall surface of the developer accommodating chamber at a position upstream of the opening and downstream of a bottom which forms the developer accommodating chamber with respect to a rotational direction of the rotation shaft, for passing detection light through an inside of the developer accommodating chamber in order to detect an amount of the developer in the developer accommodating chamber, wherein the rotation shaft includes:

a developer feeding member, which has flexibility and is mounted to the rotation shaft at one end thereof with respect to a direction of radius of gyration of said rotation shaft, for feeding the developer while deforming in contact with an inner wall of the developer accommodating chamber at the other end thereof by rotation of the rotation shaft;

a cleaning member, provided upstream of the developer feeding member with respect to the rotational direction of the rotation shaft, for sliding on the light transmitting member by the rotation of the rotation shaft; and a regulating portion for regulating movement of the developer toward a downstream side with respect to the rotational direction by falling of the developer from the developer feeding member through the rotation of the rotation shaft.

According to a further aspect of the present invention, there is provided a process cartridge detachably mountable to a main assembly of an electrophotographic image forming apparatus, comprising:

an electrophotographic image forming apparatus;

a developer carrying member for developing an electrostatic latent image formed on the electrophotographic photosensitive member with developer;

a developer chamber provided with the developer carrying member;

a developer accommodating chamber, provided separately from the developer chamber by a wall surface thereof provided with an opening for permitting passing of the developer therethrough, for accommodating the developer to be supplied into the developer chamber;

a rotation shaft rotatably supported in the developer accommodating chamber; and a light transmitting member, mounted to the wall surface of the developer accommodating chamber at a position upstream of the opening and downstream of a bottom which forms the developer accommodating chamber with respect to a rotational direction of the rotation shaft, for passing detection light through an inside of the developer accommodating chamber in order to detect an amount of the developer in the developer accommodating chamber, wherein the rotation shaft includes:

a developer feeding member, which has flexibility and is mounted to the rotation shaft at one end thereof with respect to a direction of radius of gyration of said rotation shaft, for feeding the developer while deforming in contact with an inner wall of the developer accommodating chamber at the other end thereof by rotation of the rotation shaft;

a cleaning member, provided upstream of the developer feeding member with respect to the rotational direction of the rotation shaft, for sliding on the light transmitting member by the rotation of the rotation shaft; and a regulating portion for regulating movement of the developer toward a downstream side with respect to the rotation direction by falling of the developer from the developer feeding member through the rotation of the rotation shaft.

According to a further aspect of the present invention, there is provided an electrophotographic image forming apparatus for forming an image on a recording material, comprising:

(i) an electrophotographic image forming apparatus;

(ii) a developing device comprising:

a developer carrying member for developing an electrostatic latent image formed on an electrophotographic photosensitive member with developer;

a developer chamber provided with the developer carrying member;

a developer accommodating chamber, provided separately from the developer chamber by a wall surface thereof provided with an opening for permitting passing of the developer therethrough, for accommodating the developer to be supplied into the developer chamber;

a rotation shaft rotatably supported in the developer accommodating chamber; and a light transmitting member, mounted to the wall surface of the developer accommodating chamber at a position upstream of the opening and downstream of a bottom which forms the developer accommodating chamber with respect to a rotational direction of the rotation shaft, for passing detection light through an inside of the developer accommodating chamber in order to detect an amount of the developer in the developer accommodating chamber, wherein the rotation shaft includes:

a developer feeding member, which has flexibility and is mounted to the rotation shaft at one end thereof with respect to a direction of radius of gyration of said rotation shaft, for feeding the developer while deforming in contact with an inner wall of the developer accommodating chamber at the other end thereof by rotation of the rotation shaft;

a cleaning member, provided upstream of the developer feeding member with respect to the rotational direction of the rotation shaft, for sliding on the light transmitting member by the rotation of the rotation shaft; and a regulating portion for regulating movement of the developer toward a downstream side with respect to the rotational direction by falling of the developer from the developer feeding member through the rotation of the rotation shaft; and (iii) feeding means for feeding the recording material.

According to a further aspect of the present invention, there is provided an electrophotographic image forming apparatus for forming an image on a recording material, comprising:

(i) mounting means;

(ii) a process cartridge detachably mountable to the mounting means, comprising:

an electrophotographic image forming apparatus;

a developer carrying member for developing an electrostatic latent image formed on the electrophotographic photosensitive member with developer;

a developer chamber provided with the developer carrying member;

a developer accommodating chamber, provided separately from the developer chamber by a wall surface thereof provided with an opening for permitting passing of the developer therethrough, for accommodating the developer to be supplied into the developer chamber;

a rotation shaft rotatably supported in the developer accommodating chamber; and a light transmitting member, mounted to the wall surface of the developer accommodating chamber at a position upstream of the opening and downstream of a bottom which forms the developer accommodating chamber with respect to a rotational direction of the rotation shaft, for passing detection light through an inside of the developer accommodating chamber in order to detect an amount of the developer in the developer accommodating chamber, wherein the rotation shaft includes:

a developer feeding member, which has flexibility and is mounted to the rotation shaft at one end thereof with respect to a direction of radius of gyration of said rotation shaft, for feeding the developer while deforming in contact with an inner wall of the developer accommodating chamber at the other end thereof by rotation of the rotation shaft;

a cleaning member, provided upstream of the developer feeding member with respect to the rotational direction of the rotation shaft, for sliding on the light transmitting member by the rotation of the rotation shaft; and a regulating portion for regulating movement of the developer toward a downstream side with respect to the rotational direction by falling of the developer from the developer feeding member through the rotation of the rotation shaft; and (iii) feeding means for feeding the recording material.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

Figure 2:
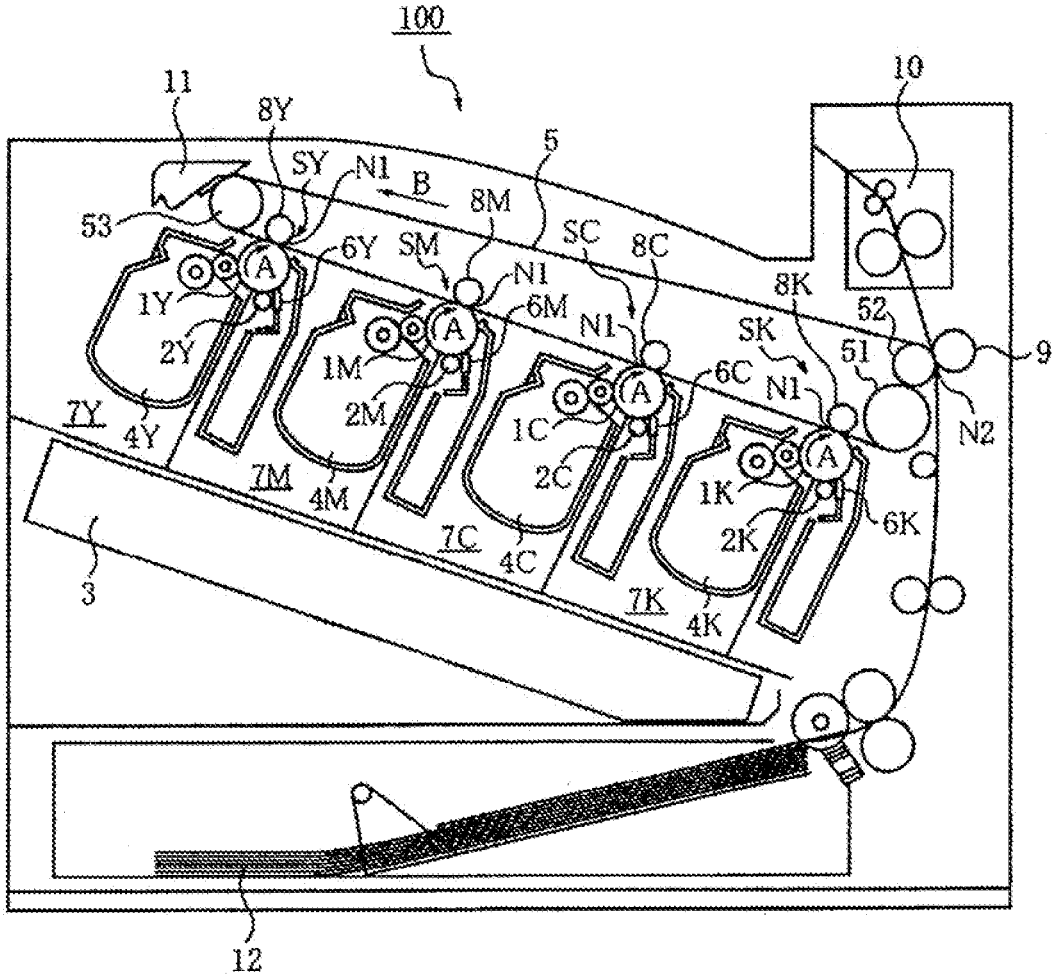
FIG. 2 is a sectional view of the electrophotographic image forming apparatus according to the present invention.

FIG. 2 shows a schematic structure of an electrophotographic image forming apparatus in this embodiment according to the present invention. In this embodiment, the electrophotographic image forming apparatus is a color electrophotographic image forming apparatus. However, the present invention is not limited to such a color electrophotographic image forming apparatus but may also be applicable to a monochromatic electrophotographic image forming apparatus and other various electrophotographic image forming apparatuses.

First, the electrophotographic image forming apparatus in this embodiment will be described regarding its general structure.

(General Structure of Image Forming Apparatus)

FIG. 2 is a schematic sectional view of an electrophotographic image forming apparatus 100 in this embodiment. The electrophotographic image forming apparatus 100 in this embodiment is a full-color laser beam printer of the in-line type, and also, is of the intermediary transfer type. The electrophotographic image forming apparatus 100 is capable of forming a full-color image on a sheet of recording material (e.g., recording paper, a plastic sheet, fabric, or the like) according to image information. The image information is inputted into a main assembly of the electrophotographic image forming apparatus from a host device, such as an image reading apparatus connected to the main assembly, a personal computer communicatably connected to the main assembly, or the like.

The electrophotographic image forming apparatus 100 has a plurality of image forming stations, first, second, third, and fourth image forming stations SY, SM, SC, and SK for forming yellow (Y), magenta (M), cyan (C), and black (K) images, respectively. In this embodiment, the first to fourth image forming stations SY, SM, SC, and SK are arranged side by side in a straight row intersecting the vertical direction.

Incidentally, in this embodiment, the first to fourth image forming stations are substantially the same in structure and operation except that they are different in the color of the image to be formed. Therefore, unless a tray needs to be differentiated, they will be described collectively by omitting suffixes Y, M, C and K added for representing constituents or means provided for associated colors.

That is, in this embodiment, the electrophotographic image forming apparatus 100 includes, as a plurality of image bearing members, four drum-type electrophotographic photosensitive members 1 which are arranged side by side in a direction intersecting the vertical direction, i.e., photosensitive drum 1. The photosensitive drum 1 is rotationally driven in a direction (clockwise direction) indicated by an arrow A in the figure by an unshown driving means (driving source). Around the photosensitive drum 1, a charging roller 2 as a charging means for uniformly charging the surface of the photosensitive drum 1, a scanner unit 3 (exposure device) as an exposing means for forming an electrostatic image (electrostatic latent image) on the surface of the photosensitive drum 1, by irradiating the photosensitive drum 1 with a laser beam based on image information are disposed. Also around the photosensitive drum 1, a developing device (hereinafter referred to as a development unit 4) as a developing means for developing the electrostatic image as a toner image and a cleaning member 6 as a cleaning means for removing developer (hereinafter referred to as toner) remaining on the surface of the photosensitive drum 1 after (toner image) transfer. Further, an intermediary transfer belt 5 as an intermediary transfer member for transferring toner images from the photosensitive drums 1 onto a recording material 12 is disposed oppositely to the four photosensitive drum 1. With respect to the rotational direction of the photosensitive drum 1, a charging position by the charging roller 2, an exposure position by the scanner unit 3, a developing position by the developing unit 4, a transfer position of the toner image onto the intermediary transfer belt 5, and a cleaning position by the cleaning member 6, are provided in this order.

Incidentally, in this embodiment, the developing unit 4 uses, as the developer, non-magnetic one-component developer, i.e., toner. Further, in this embodiment, the development unit 4 effects reverse development by bringing a developing roller as a developer carrying member in contact with the photosensitive drum 1. That is, in this embodiment, the developing unit 4 develops the electrostatic image by depositing the toner, which is charged in an identical polarity to a charge polarity (negative in this embodiment) of the photosensitive drum 1 on a portion (image portion or exposed portion) at which electric charges are attenuated by the exposure of the photosensitive drum 1 to light.

In this embodiment, the photosensitive drum 1 and processing means acting on the photosensitive drum 1 including the charging roller 2, the developing device 4, and the cleaning member 6, are integrally supported in the form of a cartridge to prepare a process cartridge 7. The process cartridge 7 is detachably mountable to the main assembly of the electrophotographic image forming apparatus 100 through mounting means, such as a mounting guide and a positioning member. In this embodiment, all the process cartridges 7 for the respective colors have the same shape. In the process cartridges 7, toners of colors of yellow (Y), magenta (M), cyan (C), and black (K), respectively, are accommodated.

The intermediary transfer belt 5, as an intermediary transferring member, formed in an endless belt, is in contact with all the four photosensitive drum 1, and circularly moves (rotates) in a direction (counterclockwise direction) indicated by an arrow B in the figure. The intermediary transfer belt 5 is stretched around, as a plurality of supporting members, a driving roller 51, a secondary transfer opposite roller 52, and a follower roller 53.

On an inner peripheral surface side of the intermediary transfer belt 5, four primary transfer rollers 8, as primary transferring means, are arranged in parallel so that they oppose the four photosensitive drums 1, respectively. The primary transfer roller 8 presses the intermediary transfer belt 5 against the photosensitive drum 1, forming thereby a nip (primary transfer nip) at a primary transfer portion N1 where the intermediary transfer belt 5 and the photosensitive drum 1 contact each other. To the primary transfer roller 8, a bias which is opposite in polarity to the normal charge polarity of the toner is applied from an unshown primary transfer bias power source (high voltage power source) as a primary transfer bias application means. As a result, the toner image on the photosensitive drum 1 is transferred (primary-transferred) onto the intermediary transfer belt 5.

Further, on an outer peripheral surface side of the intermediary transfer belt 5, a secondary transfer roller 9 as a secondary transfer means is disposed at a position in which the intermediary transfer belt 5 opposes a secondary transfer opposite roller 52 as a secondary transfer means. The secondary transfer roller 9 presses the intermediary transfer belt 5 against the secondary transfer opposite roller 52, forming thereby a nip (secondary transfer nip) at a secondary transfer portion N2 where the intermediary transfer belt 5 and the secondary transfer roller 9 contact each other. To the secondary transfer roller 9, a bias which is opposite in polarity to the normal charge polarity of the toner is applied from an unshown secondary transfer bias power source (high voltage power source as a secondary transfer bias application means. As a result, the toner image on the intermediary transfer belt 5 is transferred (secondary-transferred) onto a recording material 12. The primary transfer roller 8 and the secondary transfer 9 have the same structure.

During image formation, first, the (peripheral) surface of the photosensitive drum 1 is electrically charged uniformly by the charging roller 2. Next, the charged surface of the photosensitive drum 1 is subjected to scanning exposure by a beam of laser light emitted from the scanner unit 3 correspondingly to image information to form an electrostatic image, which is formed in accordance with the image information, on the photosensitive drum 1. Then, the electrostatic image formed on the photosensitive drum 1 is developed by the developing unit 4 as a toner image. The toner image formed on the photosensitive drum 1 is transferred (primary-transferred) onto the intermediary transfer belt 5 by the action of the transfer roller 8.

For example, during full-color image formation, the above described processes are sequentially carried out at the first to fourth image forming stations SY, SM, SC, and SK, so that respective color toner images are sequentially transferred (primary-transferred) onto the intermediary transfer belt 5 in a superposition manner.

Thereafter, the recording material 12 is conveyed to the secondary transfer portion N2 in synchronism with the movement of the intermediary transfer belt 5. The four color toner images on the intermediary transfer belt 5 are transferred together (secondary-transferred) onto the recording material 12 by the action of the secondary transfer roller 9, which is kept pressed against the intermediary transfer belt 5 through the recording medium 12.

The recording medium 12, onto which the toner images are transferred is conveyed to a fixing device 10 as a fixing means. In the fixing device 10, the toner images are fixed on the recording material 12 by application of heat and pressure to the recording material 12.

Primary transfer residual toner remaining on the photosensitive drum 1 after the primary transfer step is removed by the cleaning member 6 to be collected into the removed toner chamber. Further, secondary transfer residual toner remaining on the intermediary transfer belt 5 after the secondary transfer step is removed by an intermediary transfer belt cleaning device 11.

The image forming apparatus 100 is designed so that it can also form a monochromatic or multicolor image, with the use of only one desired, or some, (not all of them) of the image forming stations.

(Process Cartridge)

Figure 1:
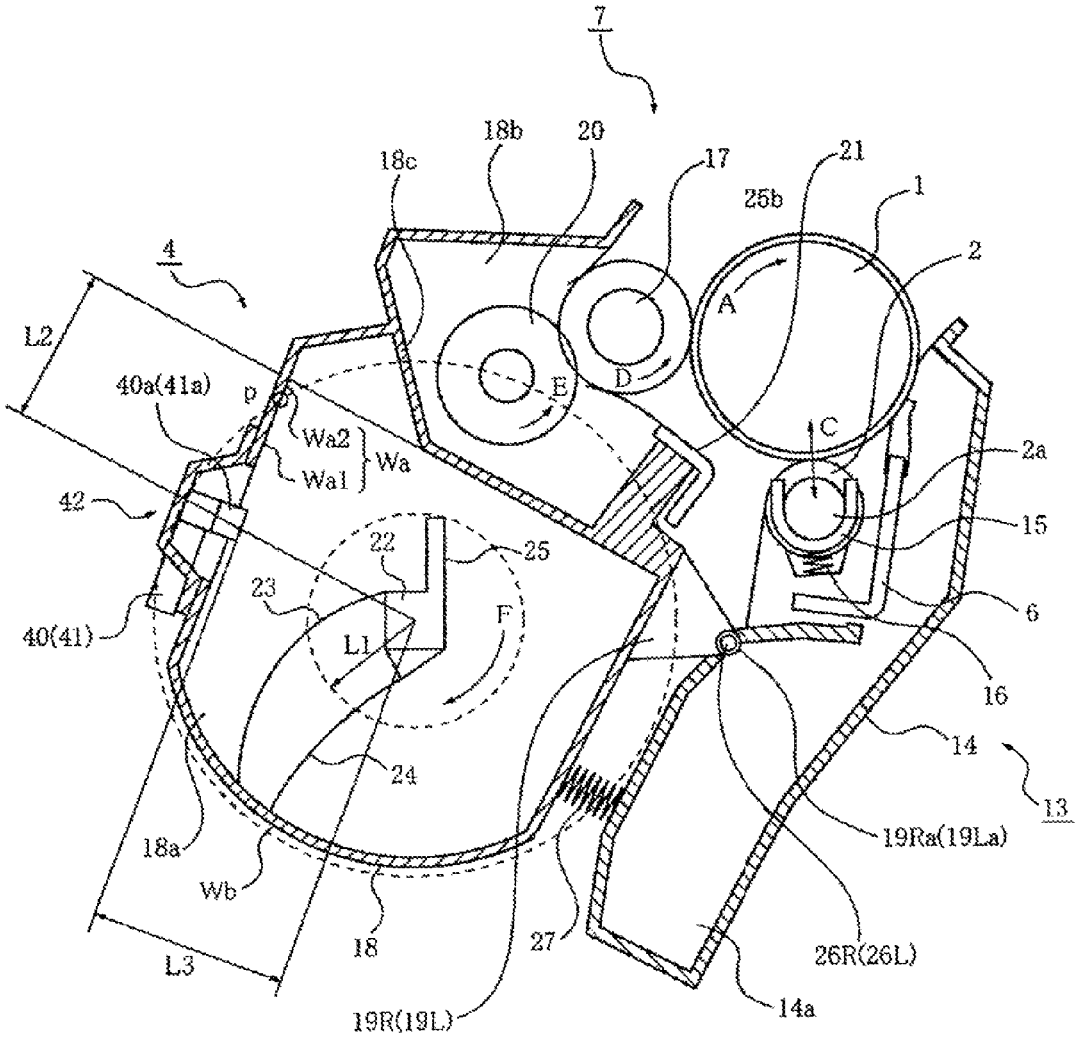
FIG. 1 is a sectional view of the process cartridge according to the present invention.

Next, the process cartridge 7 in this embodiment will be described with reference to FIG. 1. FIG. 1 is a principal sectional view of the process cartridge 7 placed in a state in which it is mounted to the electrophotographic image forming apparatus 100.

In this embodiment, a cartridge 7Y accommodating the yellow toner, a cartridge 7M accommodating the magenta toner, a cartridge 7C accommodating the cyan toner, and a cartridge 7K accommodating the black toner have the same structure.

The process cartridge 7 is divided into a photosensitive (member) unit 13 and a developing unit 4. The respective units will be described.

The photosensitive unit 13 includes the photosensitive drum 1, the charging roller 2, and the cleaning member 6, and the cleaning member frame 14.

To a cleaning member frame 14 for the photosensitive unit 13, the photosensitive drum 1 is mounted rotatably through unshown bearings. By transmitting a driving force from a driving motor (not shown) to the photosensitive unit 13, the photosensitive drum 1 is rotationally driven in the arrow A direction depending on an image forming operation. On the peripheral surface of the photosensitive drum 1, the charging roller 2 and the cleaning member 6 are disposed as described above. The residual toner removed from the surface of the photosensitive drum 1 by the cleaning member 6 falls into a removed toner chamber 14*a*.

To the cleaning member frame 14, a charging roller bearing 15 is movably mounted in a direction of an arrow C which passes through the center of the charging roller 2 and the center of the photosensitive drum 1. A shaft 2*a* of the charging roller 2 is rotatably mounted to the charging roller bearing 15, which is placed in a state in which the charging roller bearing 15 is pressed against the photosensitive drum 1 by a charging roller pressing member 16.

To a developing container 18 of the developing unit 4 (hereinafter referred to as a developing device frame 18), a developer accommodating chamber 18*a* for accommodating the toner (hereinafter referred to as a toner chamber 18*a*) and a developing chamber 18*b* in which a developing roller 17, as the developer carrying member, rotating in contact with the photosensitive drum 1 in a direction of an arrow D, are provided.

In this embodiment, the developing chamber 18*b* is disposed on the toner chamber 18*a* and communicates with the toner chamber 18*a* through an opening 18*c* located at an upper portion of the toner chamber 18*a*.

The developing roller 17 in the developing chamber 18*b* is rotatably supported by the developing device frame 18 through bearings (not shown) mounted on both end sides of the developing device frame 18.

Further, on a peripheral surface of the developing roller 17, a developer supplying member 20 rotating in contact with the photosensitive drum 1 in a direction of an arrow E (hereinafter referred to as a toner supporting roller 20) and a developing blade 21 for regulating a toner layer on the developing roller 17 are disposed.

In the toner chamber 18*a* of the developing device frame 18, a rotation shaft 22 is rotatably supported. To the rotation shaft 22, a developer feeding member 23 for stirring the accommodated toner and feeding the toner to the toner supplying roller 20 (hereinafter referred to as a toner feeding member 23) is provided. Further, to the rotation shaft 22, a cleaning member 24 for cleaning a light transmitting window 40*a* as a projection window and for cleaning a light transmitting window 41*a* as a light receiving window and a receiving portion 25 for receiving (stopping) the toner falling from the toner feeding member 23 into a toner container, are provided. The rotation shaft 22 will be described later more specifically.

In the neighborhood of a longitudinal central portion on an outer side of a wall surface Wa constituting the toner chamber 18*a*, a light transmitting member 42, which is formed by a light emission guide portion 40, a light receiving guide portion 41, and a detecting portion 43 integrally are provided. The shape of the light transmitting member 42 will also be described later.

The developing unit 4 is rotatably connected to the photosensitive unit 13 about shafts 26R and 26L engaged in holes 19Ra and 19La provided to bearings 19R and 19L. During the image formation operation by the process cartridge 7, the developing unit 4 is urged by a pressing spring 27 to rotate about the shafts 26R and 26L, so that the developing roller 17 press-contacts the photosensitive drum 1.

(Toner Feeding Method)

A toner feeding constitution in this embodiment will be described. The toner chamber 18*a* has a bottom wall surface Wb as a bottom and the inclined wall surface Wa along a rotational direction F of the toner feeding member 23 in a state in which the process cartridge 7 is mounted to the electrophotographic image forming apparatus main assembly 100, i.e., with an attitude shown in FIG. 1. The inclined wall surface Wa has a contact portion Wa 1 contactable to the toner feeding member 23 and a non-contact portion Wa 2 which is located downstream of the contact portion Wa1 and upstream of the opening 18*c* with respect to the rotational direction of the toner feeding member 23 and is not in contact with the toner feeding member 23.

The toner feeding member 23 is urged and deformed against its elastic force by press-contact (sliding) with the bottom wall surface Wb and the contact portion Wa1. Further, the toner feeding member 23 is configured to feed the toner in a state in which it carries the toner on its surface on its rotational direction downstream side by being rotated in a contact state with the bottom wall surface Wb and the contact surface Wa1. When a free end of the toner feeding member 23 reaches the non-contact portion Wa1, by the rotation of the toner feeding member 23, the press-contact of the toner feeding member 23 with the inner wall surface of the toner chamber 18*a* is eliminated. When the press-contact of the toner feeding member 23 is eliminated, the toner feeding member 23 is liable to change its shape to a natural state (an original shape) by its own elastic restoring force. By this shape change of the toner feeding member 23 in the restoring direction, the toner which is carried and fed on the toner feeding member 23 leaps up, against gravity, toward the opening 18*c* located downstream of the contact portion Wa1 and the non-contact portion Wa2 with respect to the rotational direction of the toner feeding member 23. In the present invention, a boundary point P between the contact portion Wa1 and the non-contact portion Wa2 is provided above the light transmitting windows 40*a* and 41*a*.

(Light Transmitting Member)

Figure 3:
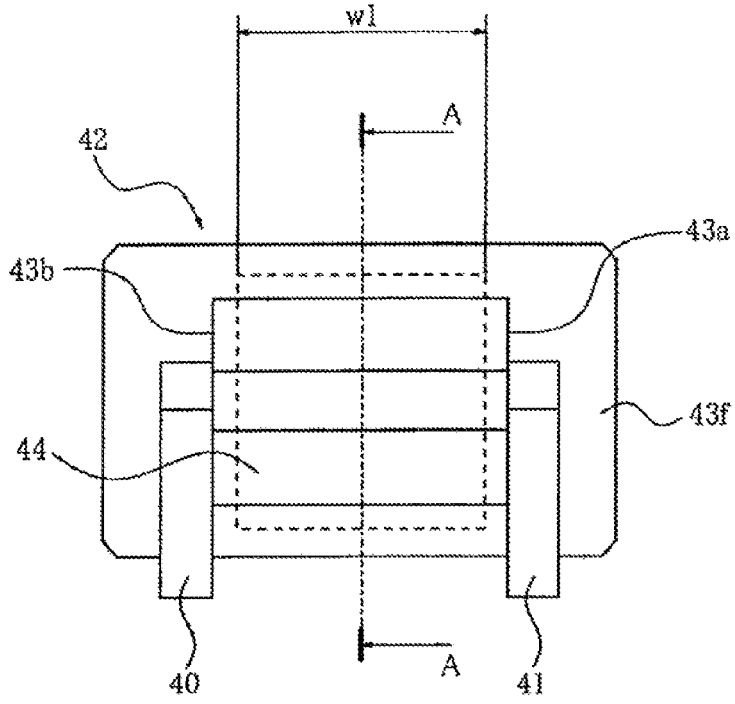
FIGS. 3(*a*) and 3(*b*) are schematic views of a light transmitting member in the present invention.
Figure 3:
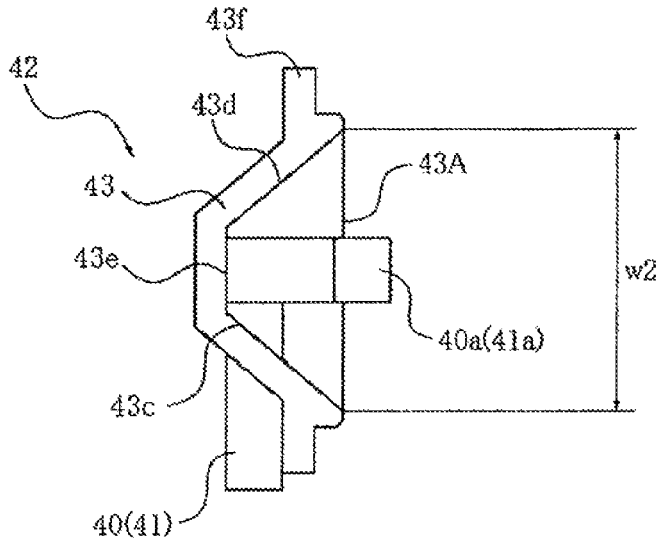

FIGS. 3(*a*) and 3(*b*) are schematic views of the light transmitting member 42 in this embodiment. In this embodiment, between the light emission guide portion 40 and the light receiving guide portion 41, the detecting portion 43 having a shape projected toward the outside of the toner feeding member 3 with respect to a direction of the radius of gyration of the toner feeding member 23 is formed. The detecting portion 43 is a box-like space which communicates with the toner chamber 18*a* and is provided with an opening 43A having a long-side length w1 and short-side length w2. That is, the detecting portion 43 includes both side walls 43*a* and 43*b* oppositely disposed with respect to the rotational direction of the toner feeding member 23, wall surfaces 43*c* and 43*d* formed oppositely to each other on an upstream side and a downstream side, respectively, with respect to the rotational direction of the toner feeding member 23, and a wall surface 43*e* disposed oppositely to the opening 43A. In this embodiment, the light transmitting member 42 is prepared by integrally forming the light emission guide portion 40, the light receiving guide portion 41, and the detecting portion 43.

(Structure of Rotation Shaft)

Figure 4:
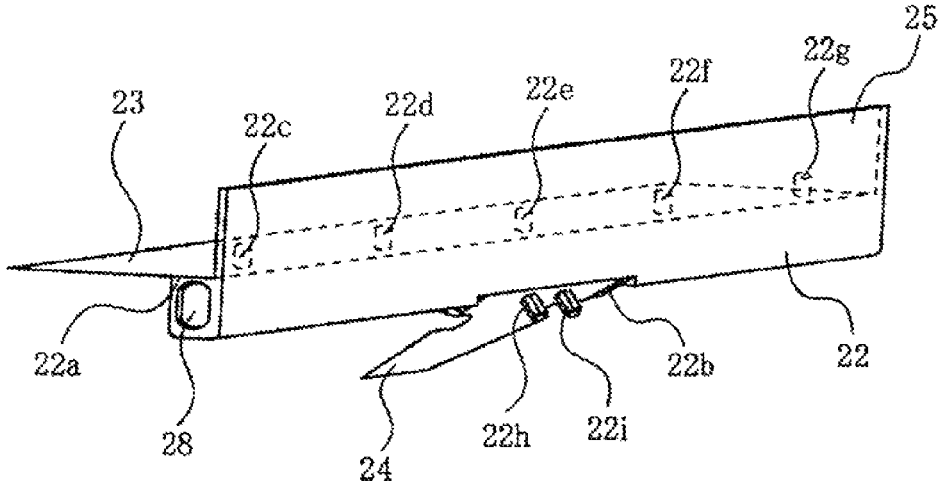
FIGS. 4(*a*) and 4(*b*) are schematic views of a rotation shaft in the present invention.
Figure 4:
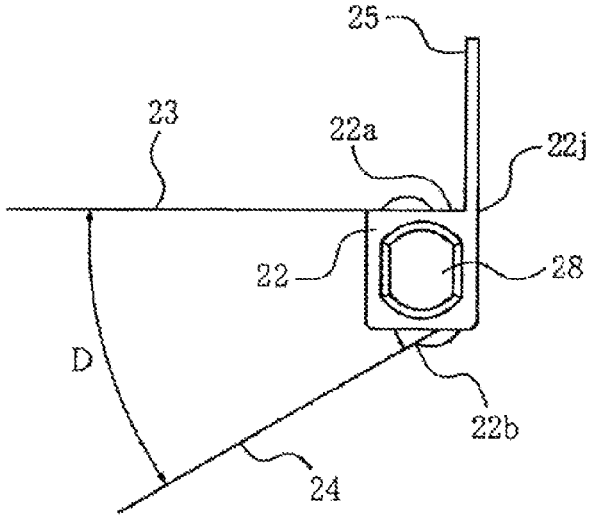

The rotation shaft 22 in the present invention will be described. FIGS. 4(*a*) and 4(*b*) are schematic views of the rotation shaft 22 in the present invention.

As shown in FIG. 4(*a*), on a surface 22*a* constituting the rotation shaft 22, the toner feeding member 23 for performing the toner feeding is mounted in substantially the entire area of the toner feeding member 23 with respect to the longitudinal direction of the toner feeding member 23. The toner feeding member 23 is a rectangular sheet member suitably prepared by using a flexible resin-made sheet, such as a polyester film, a polyphenylene sulfide film, or a polycarbonate film, having a thickness of, e.g., 50-250 μm. The toner feeding member 23 is fixed to the rotation shaft 22 at one end thereof with respect to the direction of the radius of gyration by subjecting bosses 22*c* to 22*g*, provided to the rotation shaft 22, to thermal caulking or ultrasonic welding. The toner feeding member 23 is set so that the length thereof is longer than the distance from the center of the rotation shaft 22 to the contact portion Wa1 by about 5 mm to about 20 mm.

Figure 5:
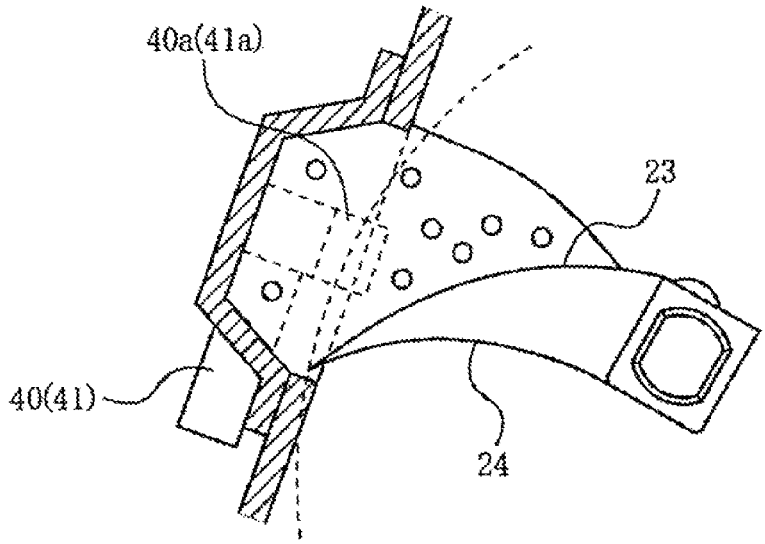
FIGS. 5(*a*) and 5(*b*) are schematic views for illustrating a toner feeding member and a cleaning member on the basis of an amount of toner.
Figure 5:
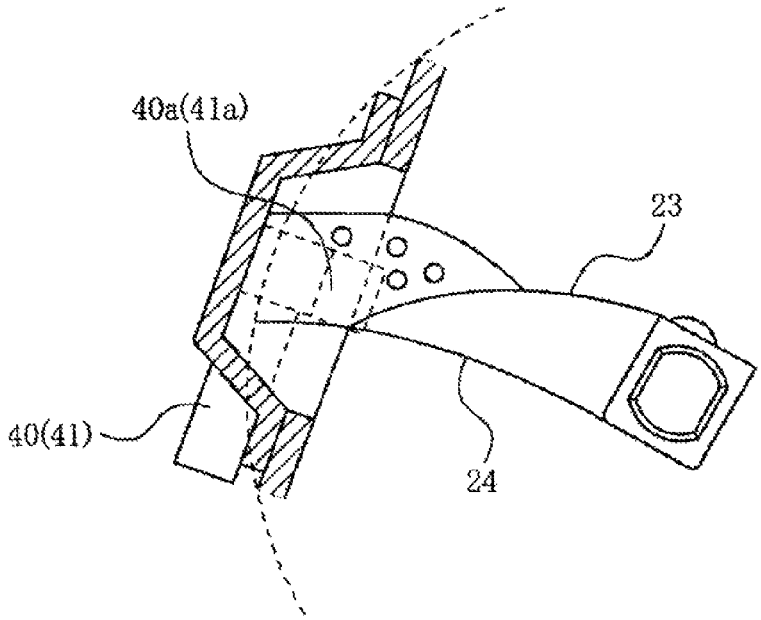

To the rotation shaft 22, a surface 22*b* located oppositely to the mounting surface 22*a* of the toner feeding member 23 is provided with a phase D of 30 degrees with respect to the toner feeding member 23 in the counterclockwise direction. The cleaning member 24 is fixed at the surface 22*b*, similarly as in the case of the toner feeding member 23, to the rotation shaft 22 at one end thereof with respect to the direction of the radius of gyration by subjecting bosses 22*h* and 22*i*, provided to the rotation shaft 22, to the thermal caulking or the ultrasonic welding. The cleaning member 24 is provided with the phase D of 30 degrees with respect to the toner feeding member 23 so that the free end of the toner feeding member 23 does not contact the cleaning member when the toner feeding member 23 is deformed in contact with the inner wall surface of the toner chamber 18*a*. FIGS. 5(*a*) and 5(*b*) are schematic views for illustrating the case where the toner feeding member 23 contacts the cleaning member 24, wherein FIG. 5(*a*) shows a state in which the amount of toner fed by the toner feeding member 23 is large and FIG. 5(*b*) shows a state in which the fed toner amount is small. As shown in FIGS. 5(*a*) and 5(*b*), when the toner feeding member 23 contacts the cleaning member 24, a contact state of the cleaning member 24 with the light transmitting windows 40*a* and 41*a* varies depending on the amount of toner fed by the toner feeding member 23. That is, as the amount of toner fed by the toner feeding member 23 is larger, the cleaning member 24 is pressed toward the upstream side with respect to the rotational direction in a larger degree. When the contact state of the cleaning member 24 with the light transmitting windows 40*a* and 41*a* is changed, a wiping state of the toner deposited on the surfaces of the light transmitting windows 40*a* and 41*a* is also changed, thus causing variation in light transmission-type remaining toner amount detection accuracy. In order to improve the light transmission-type remaining toner amount detection accuracy, it is desirable that the toner feeding member 23 and the cleaning member 24 do not contact each other. Therefore, as described above, in this embodiment, the phase of the cleaning member 24 with respect to the toner feeding member 23 is set at 30 degrees. However, the phase of 30 degrees is not a necessary condition since it is important that the free end of the toner feeding member 23 is disposed so as not to contact the cleaning member 24 when the toner feeding member 23 is deformed as described above.

Figure 6:
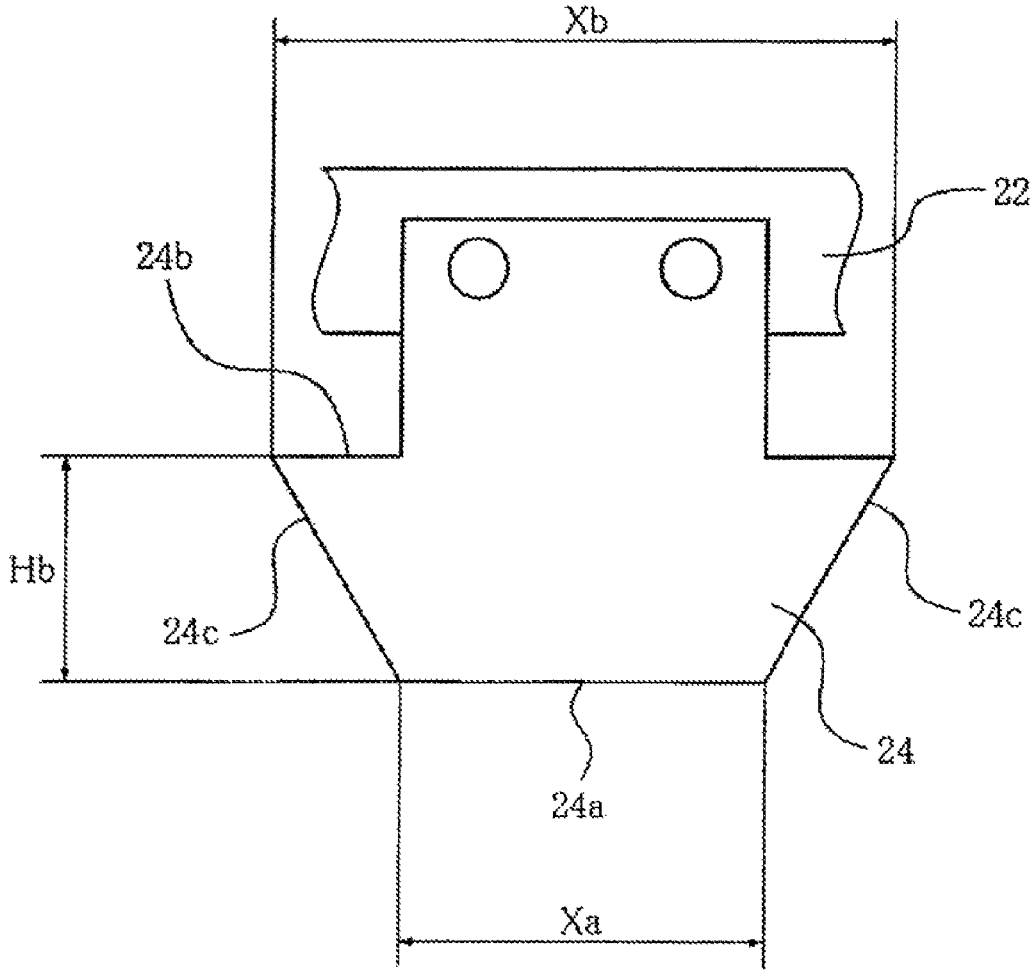
FIG. 6 is a schematic view of the cleaning member in the present invention.

FIG. 6 is a schematic view of the cleaning member 24. As shown in FIG. 6, the free end of the cleaning member 24 has a trapezoidal shape such that an outer edge portion 24*a* of the cleaning member 24 with respect to the direction of the radius of gyration is narrow (Xa) and an inner edge portion 24*b*, which is inwardly separated from the outer edge portion 24*a* (toward the rotation shaft 22 side) by a height Hb, is wide (Xb), i.e., Xa<Xb. The trapezoidally shaped cleaning member 24 has both inclined side edge portions 24*c*, which contact the light transmitting windows 40*a* and 41*a*, which are provided in a pair, to wipe out the toner deposited on the light transmitting windows 40*a* and 41*a*. The cleaning member 24 can, e.g., be prepared suitably by using a flexible resin material-made sheet such as the polyester film or the polyphenylene sulfide film. The thickness of the sheet-like member may suitably be 50-250 μm in order that the cleaning member 24 can enter the spacing between the light transmitting windows 40*a* and 41*a*.

Further, to the rotation shaft 22, the receiving portion 25 having a phase of 90 degrees (right angle) from the toner feeding member 23 on the downstream side of the toner feeding member 23 with respect to the rotational direction of the rotation shaft 22 is provided at a position between the toner feeding member 23 and the cleaning member 24 on a downstream side of the toner feeding member 23 with respect to the rotational direction of the rotation shaft 22, as shown in FIGS. 4(*a*) and 4(*b*). The receiving portion 25 is formed so that a surface 22*j* thereof having the phase of 90 degrees (right angle) from the mounting surface 22*a* of the toner feeding member 23 on the downstream side of the toner feeding member 23 with respect to the rotational direction of the rotation shaft 22 projects in an outward direction of the radius of gyration over substantially the entire area with respect to the longitudinal direction of the rotation shaft 22. As a result, the receiving portion 25 can be formed without increasing the size of a (metal) mold for molding the rotation shaft 22.

In this embodiment, as shown in FIG. 1, a radius L1 of gyration from the rotational center of the rotation shaft 22 to an end of the receiving portion 25 is provided so as to be smaller than lengths L2 and L3, i.e., L1<L2 and L3. The length L2 is a minimum of a rectilinear distance from the rotational center of the rotation shaft 22 to the inner wall surface of the toner chamber 18*a*. Further, the length L3 is a straight line connecting the rotational center of the rotation shaft 22 and the light transmitting windows 40*a* and 41*a*. That is, the end of the receiving portion 25 does not contact the inner wall surface of the toner chamber 18*a* or the light transmitting windows 40*a* and 41*a* in the rotational motion of the rotation shaft 22, so that the receiving portion 25 does not have a toner feeding function and a cleaning function for the light transmitting windows.

The transmission of the driving force to the rotation shaft 22 is performed, as shown in FIGS. 4(*a*) and 4(*b*), by a driving gear (not shown) which is inserted into an engaging hole 28 provided to the rotation shaft 22 by penetration of the side wall of the toner chamber 18*a*.

(Light Transmission-Type Remaining Toner Amount Detection)

Figure 7:
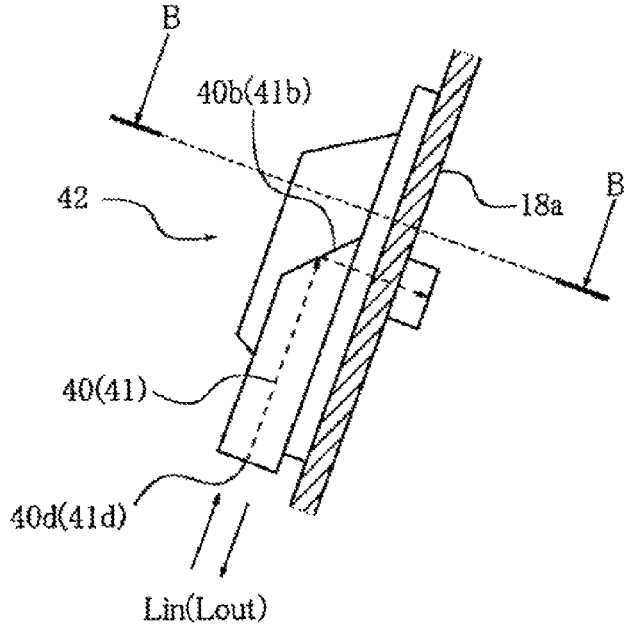
FIGS. 7(*a*) and 7(*b*) are schematic views for illustrating a remaining toner amount detection path in the present invention.
Figure 7:
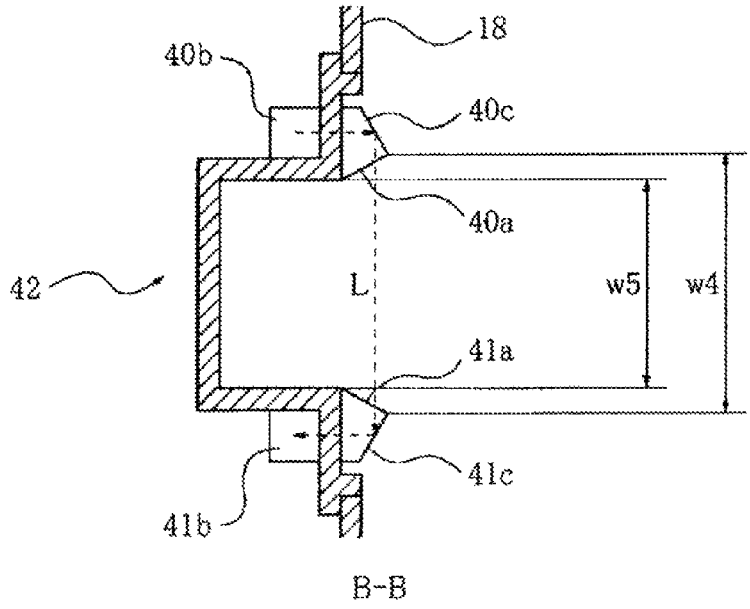

The light transmission-type remaining toner amount detection in the present invention will be described. FIGS. 7(*a*) and 7(*b*) are schematic views showing an optical path in the present invention.

The light transmitting window 40*a* of the light emission guide portion 40 and the light transmitting window 41*a* of the light receiving guide portion 41 are, as shown in FIG. 7(*b*), oppositely disposed along a rotational axis direction of the toner feeding member 23. As shown in FIG. 7(*a*), detection light Lin emitted from a light-emitting element (a light-emitting portion such as the LED) (not shown) mounted to the electrophotographic image forming apparatus main assembly 100 is guided into the light emission guide portion 40. The detection light Lin is polarized, by a reflecting surface 40*b* of the light emission guide portion 40, toward the toner chamber 18*a*. The polarized detection light is, as shown in FIG. 7(*b*), further polarized, by a reflecting surface 40*c*, toward the light transmitting window 40*a*, thus being introduced into the toner chamber 18*a*. Detection light L having passed through the light transmitting window 40*a* of the light emission guide portion 40 passes through the inside of the toner chamber 18*a* and is guided to the light transmitting window 41*a* of the light receiving portion 41. Thereafter the detection light L is polarized by reflecting surfaces 41*c* and 41*b* of the light receiving portion 41 and passes through the light receiving guide portion 41 to reach the outside of the process cartridge. Detection light Lout coming out of the process cartridge is guided to a light-receiving element (a light-receiving portion such as a photo-transistor (not shown) mounted to the electrophotographic image forming apparatus main assembly. In this embodiment, as shown in FIG. 7(*b*), the oppositely disposed light transmitting windows 40*a* and 41*a* are formed so that a separation distance w4 on a side adjacent to the toner chamber 18*a* is larger than a separation distance w5 on a side apart from the toner chamber 18*a*, i.e., w4<w5.

Therefore, as described above, the cleaning member 24 is formed in the trapezoidal shape in order to clean the surfaces of the light transmitting windows 40*a* and 41*a* which are the oppositely disposed inclined surfaces.

Figure 8:
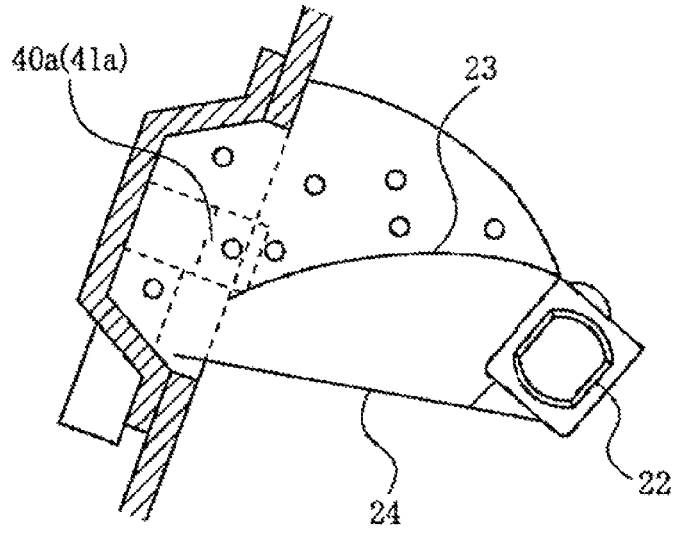
FIGS. 8(*a*) and 8(*b*) are schematic views for illustrating optical remaining toner amount detection in the present invention.
Figure 8:
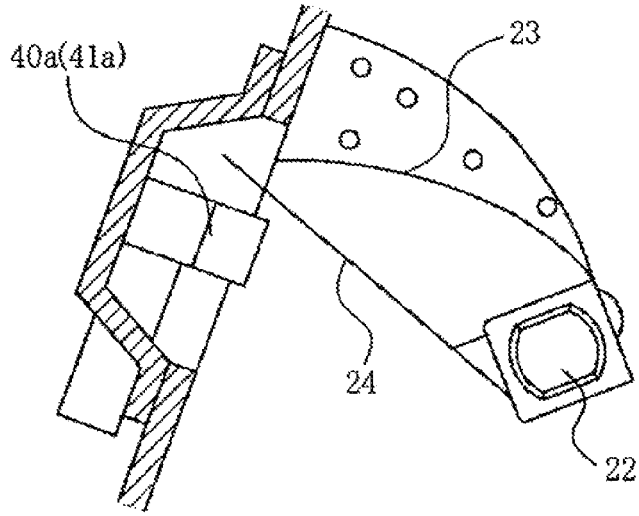

FIG. 8(*a*) is a schematic view showing a state immediately before the light transmitting windows 40*a* and 41*a* are cleaned by the cleaning member 24. The detection light L is blocked on the inside of the toner chamber 18*a* and thus does not reach the light transmitting window 41*a*, so that the detection light is not detected by the light-receiving portion in the electrophotographic image forming apparatus main assembly.

On the other hand, FIG. 8(*b*) is a schematic view showing a state immediately after the light transmitting windows 40*a* and 41*a* are cleaned by the cleaning member 24. The detection light L passes through the inside of the toner chamber 18*a* and is detected via the light transmitting window 41*a* by the light-receiving portion in the electrophotographic image forming apparatus main assembly.

In the above-described constitution, the remaining toner amount in the toner chamber 18*a* is detected by measuring a light-receiving time of the detection light L, per one rotation of the toner feeding member 23, which has passed through the inside of the toner chamber 18*a* and is received by the light-receiving portion of the electrophotographic image forming apparatus.

Figure 9:
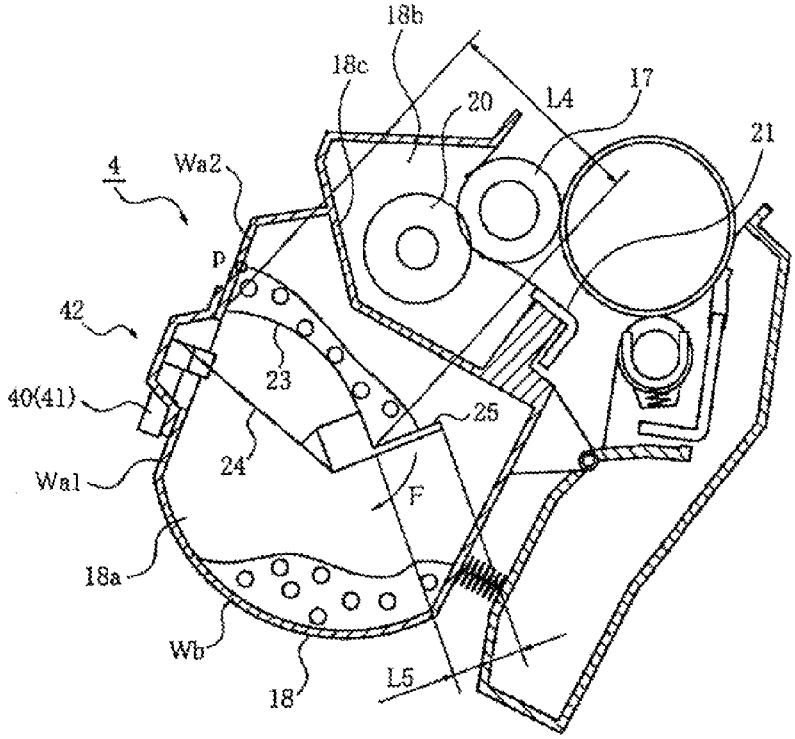
FIGS. 9(*a*) and 9(*b*) are schematic views for illustrating toner feeding in the present invention.
Figure 9:
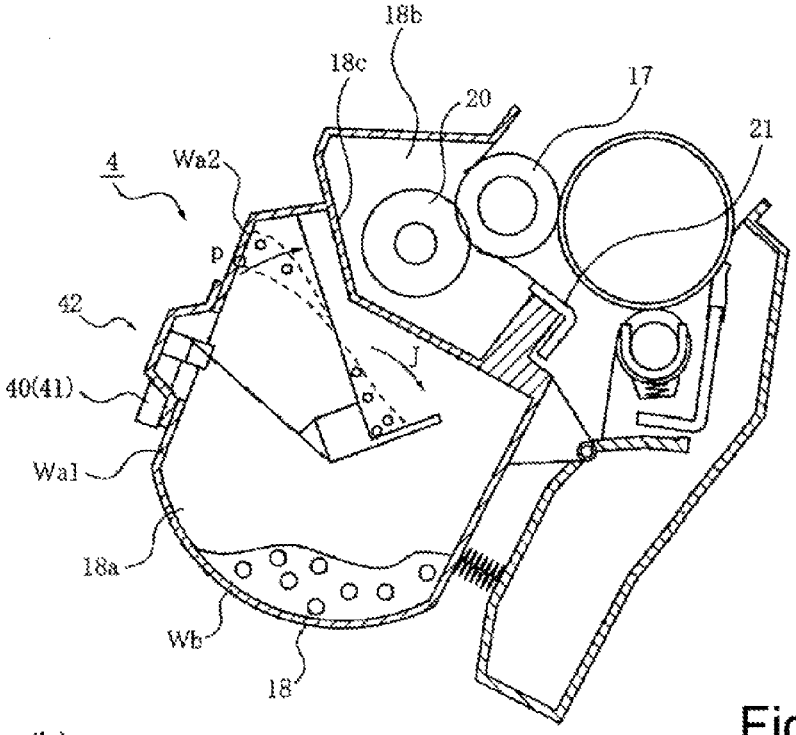

In the present invention, as described above with respect to the toner feeding method, the toner is fed by the toner feeding member 23 to a position above a horizontal line passing through the rotation center of the rotation shaft 22. In this case, the toner fed by the toner feeding member 23 slides off the surface of the toner feeding member 23 by gravity. When the toner vigorously slides off the toner feeding member 23, the toner scatters in the toner chamber 18*a*. Further, the toner in the toner chamber 18*a* also scatters by air flow generated when the toner feeding member 23 recovers its original shape after the deformation. When the scattered toner is deposited on the light transmitting windows 40*a* and 41*a* after the cleaning, the deposited toner causes variation in remaining toner amount detection accuracy. Therefore, as described above with respect to the constitution of the rotation shaft, as the means for suppressing the scattering toner, the rotation shaft 22 is provided with the receiving portion 25 provided downstream of the toner feeding member 23 and upstream of the cleaning member 24 with respect to the rotational direction of the rotation shaft 22. FIGS. 9(*a*) and 9(*b*) are schematic views showing a state in which the toner is fed and then leaps up into the developing chamber 18*b*, wherein FIG. 9(*a*) shows a state immediately before the toner feeding member 23 reaches the boundary point P. When the rotation shaft 22 is further rotated from the time when the mounting surface of the toner feeding member 23 is placed in a horizontal state, the toner slides off the surface of the toner feeding member 23 by gravity. The toner sliding off the toner feeding member 23 until the toner feeding member 23 reaches the non-contact portion Wa1 of the toner chamber 18*a* is received by the receiving portion 25. The toner remaining on the receiving portion 25 slides off the receiving portion 25 by the rotation of the rotation shaft 22 but the slide-off distance (length) L5 of the toner from the receiving portion 25 is shorter than the slide-off distance (length) L4 of the toner from the toner feeding member 23, so that the toner scattering by the falling can be suppressed. FIG. 9(*b*) shows a state of such a moment that the deformation of the toner feeding member 23 is eliminated. When the deformation of the toner feeding member 23 is drastically eliminated, in the toner chamber 18*a*, air flow J occurs toward the rotational direction of the toner feeding member 23. However, the receiving portion 25 is provided downstream of the rotation shaft 22 more than the toner feeding member 23 with respect to the rotational direction of the rotation shaft 22, so that the air flow J, which has occurred by the toner feeding member 23 is suppressed by the receiving portion 25. In this case, the toner scatters between the toner feeding member 23 and the receiving portion 25 but the receiving portion 25 is located upstream of the light transmitting windows 40*a* and 41*a*, so that the amount of the scattered toner deposited on the light transmitting windows 40*a* and 41*a* can be considerably reduced. As a result, even in the constitution in which the toner is fed upwardly by utilizing the elastic force of the toner feeding member 23, the light transmission-type remaining toner amount detection can be performed stably with accuracy.

Embodiment 2

Next, another embodiment according to the present invention will be described. In this embodiment, fundamental structures of the developing device, the process cartridge, and the image forming apparatus are identical to those in Embodiment 1. Therefore, constituents or means having the same or corresponding function and structure as those in Embodiment 1 are represented by the same reference numerals or symbols, thus being omitted from detailed description.

Figure 10:
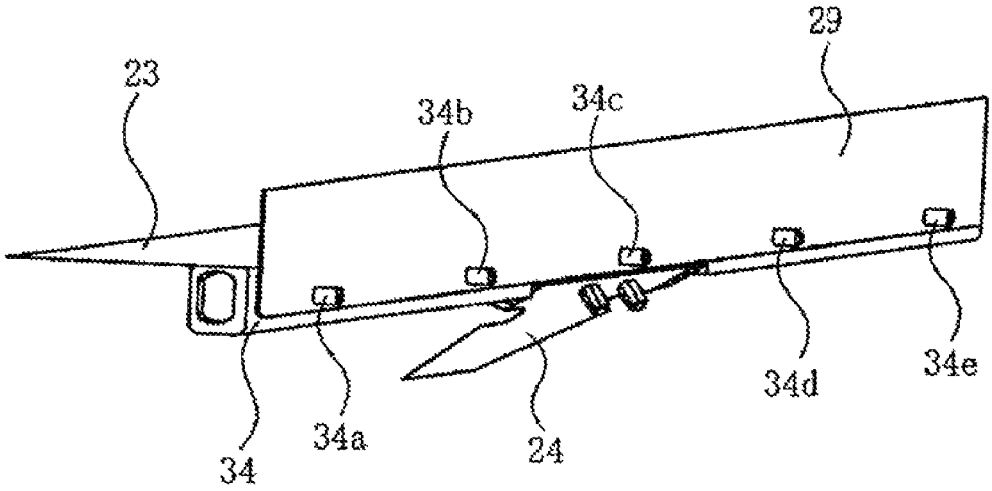
FIGS. 10 and 11 are perspective views of rotation shafts in Embodiment 2 and Embodiment 3, respectively.

FIG. 10 is a perspective view of the rotation shaft in this embodiment. A rotation shaft 34 is provided with a flexible receiving member 29 downstream of the toner feeding member 23 and upstream of the cleaning member 34 with respect to the rotational direction of the rotation shaft 34. The receiving member 29 is a rectangular sheet member suitably prepared by using a flexible resin material-made sheet, such as the polyester film or the polycarbonate film, e.g., having a thickness of 50-200 μm. The receiving member 29 is, similarly as in the cases of the toner feeding member 23 and the cleaning member 24, fixedly mounted to the rotation shaft 34 at an end surface with respect to the direction of the radius of gyration by subjecting bosses 34*a* to 34*e*, provided on the rotation shaft 34, to the thermal caulking or the ultrasonic welding. Further, a free end of the receiving member 29 does not contact the inner wall surface of the toner chamber 18*a* and the light transmitting windows 40*a* and 41*a* in the rotational motion of the rotation shaft 34.

In this embodiment, the receiving member 29 is constituted by the flexible sheet member, so that the receiving member 29 can be deformed by being subjected to toner resistance during the rotation of the rotation shaft 34 in the case where the toner amount in the toner chamber 18*a* is large. As a result, the toner resistance exerted on the receiving member 29 is decreased, so that the torque necessary to rotate the rotation shaft 34 can be reduced.

Embodiment 3

Next, another embodiment according to the present invention will be described. In this embodiment, fundamental structures of the developing device, the process cartridge, and the image forming apparatus are identical to those in Embodiment 1 and Embodiment 2. Therefore, constituents or means having the same or corresponding function and structure as those in Embodiment 1 and Embodiment 2 are represented by the same reference numerals or symbols, thus being omitted from detailed description.

Figure 11:
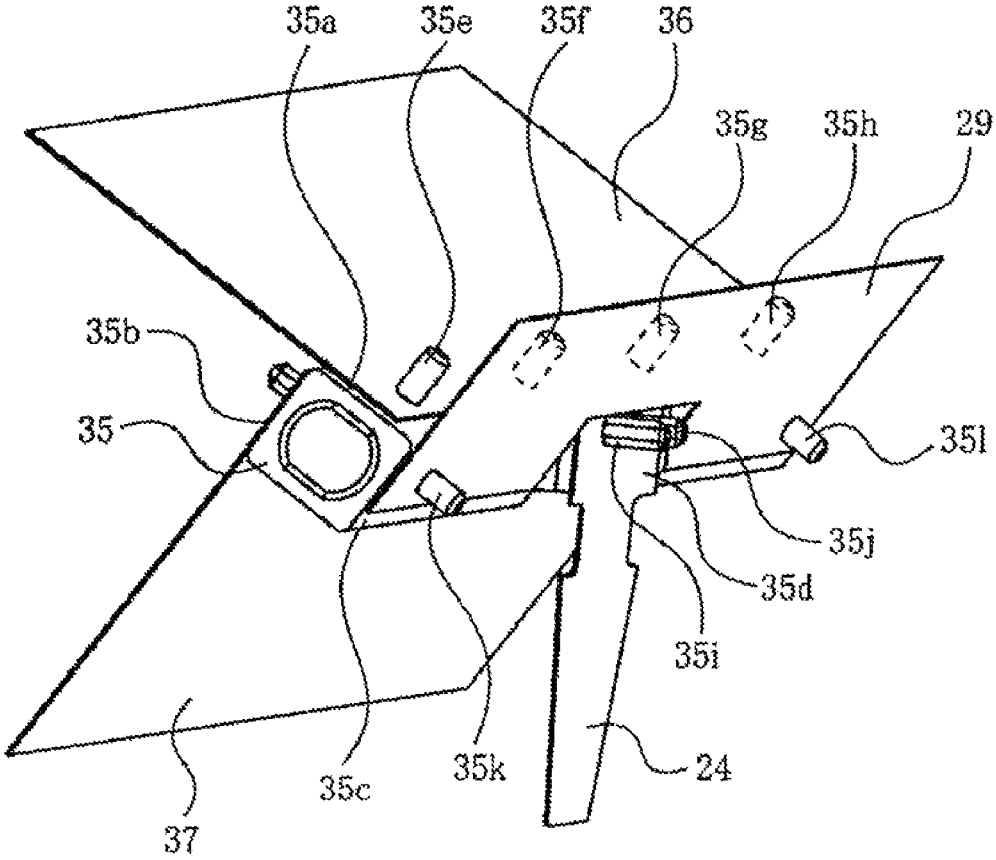

FIG. 11 is a perspective view of a rotation shaft 35 in this embodiment. The rotation shaft 35 is provided with a first toner feeding member 36 at a surface 35*a*. The first toner feeding member 36 is fixed to the rotation shaft 35 at an end thereof with respect to the direction of the radius of gyration of the first toner feeding member 36 by subjecting bosses 35*e* to 35*h* provided on the rotation shaft 35 to the thermal caulking or the ultrasonic welding. Further, the rotation shaft 35 is provided with a second toner feeding member 37 at a surface 35*b* located upstream of the surface 35*a* with an angle of substantially 90 degrees with respect to the rotational direction of the rotation shaft 35. The second toner feeding member 37 is also fixed to the rotation shaft 35 at an end thereof with respect to the direction of the radius of gyration similarly as in the case of the first toner feeding member 36 by subjecting bosses (not shown) provided to the rotation shaft 35 to the thermal caulking or the ultrasonic welding. The cleaning member 24 is provided at a surface 35*d* which is located at a longitudinal central portion of a surface 35*c* opposite from the surface 35*b* and has a phase of 30 degrees with respect to the surface 35*b* in the counterclockwise direction. The cleaning member 24 is fixed to the rotation shaft 35 at an end thereof on the surface 35*d* with respect to the direction of the radius of gyration by subjecting bosses 35*i* and 35*j* provided on the rotation shaft 35 to the thermal caulking or the ultrasonic welding. At the surface 35*c* excluding the surface 35*d*, the receiving member 29 is provided. The receiving member 29 is fixed to the rotation shaft 35 at one end thereof on the surface 35*c* with respect to the direction of the radius of gyration by subjecting bosses 35*k* and 35*l* provided to the rotation shaft 35 to the thermal caulking or the ultrasonic welding.

Figure 12:
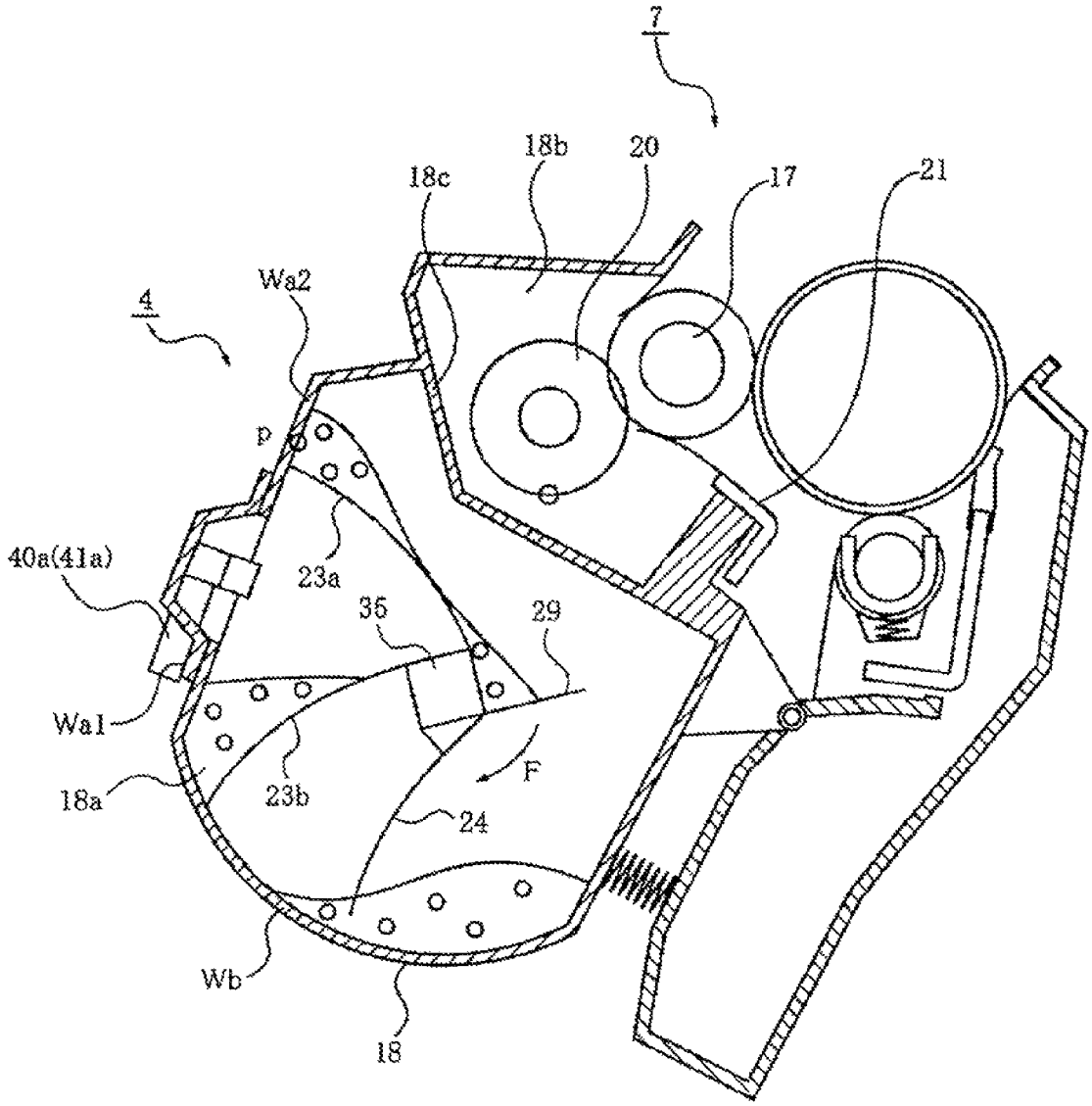
FIG. 12 is a sectional view of a process cartridge provided with the rotation shaft in Embodiment 3.

FIG. 12 is a schematic sectional view of the process cartridge provided with the rotation shaft 35 in this embodiment. In this embodiment, with respect to the rotational direction of the rotation shaft 35, the receiving member 29 is provided downstream of the first toner feeding member 36, thus receiving the toner sliding off the first toner feeding member 36. When the first toner feeding member 36 reverts to its original shape after the deformation, the receiving member 29 is, similar to Embodiment 1, located upstream of the light transmitting windows 40*a* and 41*a*, so that it is possible to reduce an amount of the scattered toner deposited on the light transmitting windows 40*a* and 41*a*. Further, in this embodiment, with respect to the rotational direction of the rotation shaft 35, the second toner feeding member 37 is provided upstream of the first toner feeding member 36, so that the second toner feeding member 37 feeds the toner which has slid off the first toner feeding member 36.

The toner sliding off the second toner feeding member 37 is received by the first toner feeding member 36. When the second toner feeding member 37 passes through the boundary point P, the first toner feeding member 36 is located upstream of the light transmitting windows 40*a* and 41*a*, so that the amount of the scattered toner deposited on the light transmitting windows 40*a* and 41*a* is small.

In this embodiment, two toner feeding members are provided, so that the toner can be fed in a larger amount and similar to Embodiment 1, it is possible to perform the light transmission-type remaining toner amount detection stably with accuracy.

Embodiment 4

Next, another embodiment according to the present invention will be described. In this embodiment, fundamental structures of the developing device, the process cartridge, and the image forming apparatus are identical to those in Embodiment 1. Therefore, constituents or means having the same or corresponding function and structure as those in Embodiment 1 are represented by the same reference numerals or symbols, and a detailed description thereof is omitted.

Figure 13:
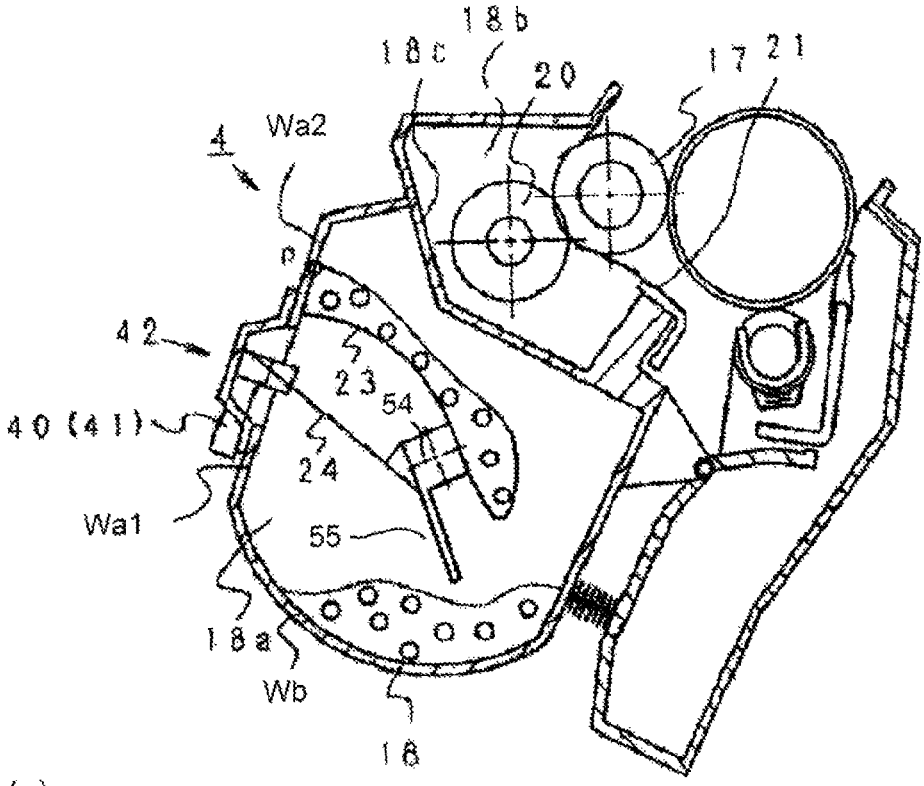
FIGS. 13(*a*) and 13(*b*) are schematic views for illustrating toner feeding in Embodiment 4.
Figure 13:
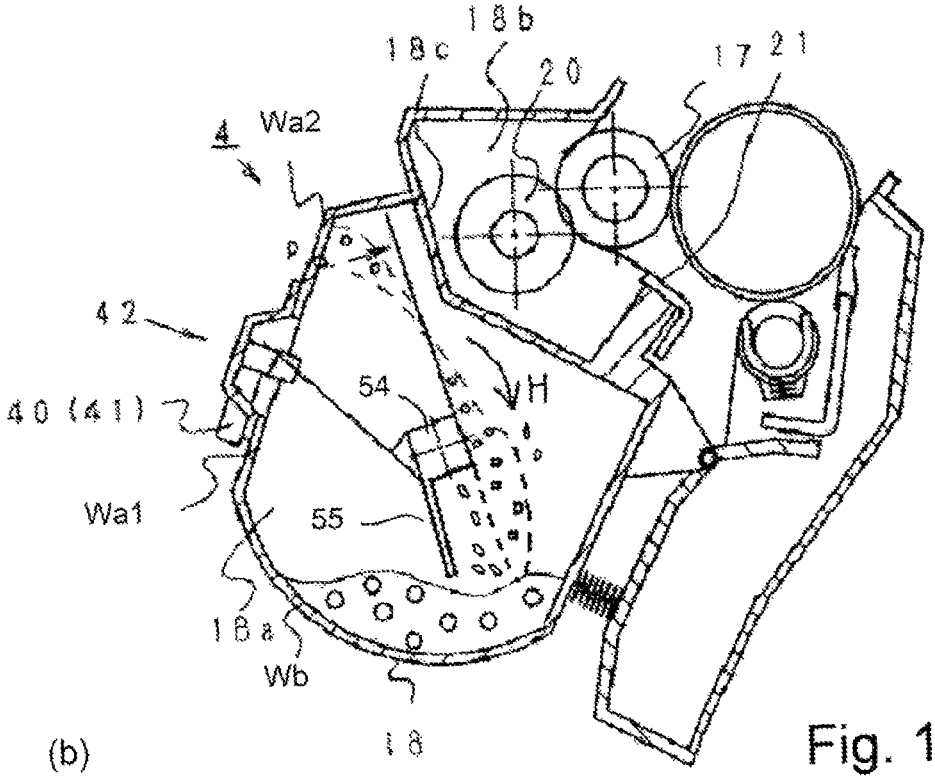

FIGS. 13(*a*) and 13(*b*) are schematic views showing a state in which the toner is fed and then leaps up into the developing chamber 18*b*, wherein FIG. 13(*a*) shows a state immediately before the toner feeding member 23 reaches the boundary point P. When the rotation shaft 22 is further rotated from the time when the mounting surface of the toner feeding member 23 is placed in a horizontal state, the toner downwardly slides off the surface of the toner feeding member 23 by the gravity. Then, as shown in FIG. 13(*b*), the toner (downwardly) sliding off the surface of the toner feeding member 23 reaches the toner stagnating at a lower portion of the toner chamber 18*a*.

A regulating portion 55 is provided at a position between the toner feeding member 23 and the cleaning member 24 on a downstream side of the toner feeding member 23 with respect to the rotational direction of the rotation shaft 22, as shown in FIGS. 13(*a*) and 13(*b*).

This embodiment is different from Embodiment 1 in that the regulating portion 55 is provided at a position in which the regulating portion 55 forms an angle, with respect to the rotation shaft 54, at which the regulating portion 55 does not receive the toner which has slid off the surface of the toner feeding member 23 toward the lower portion of the toner chamber 18*a*. That is, the toner feeding member 23 and the regulating portion 55 have a phase difference of substantially 180 degrees. However, the toner carried by air flow H occurring by the rotation of the toner feeding member 23 and the toner rising up from the lower portion of the toner chamber 18*a* by the falling of the toner can be regulated so as not to move toward the downstream side in the rotational direction of the toner feeding member 23.

That is, similarly as in Embodiment 1, the toner scatters between the toner feeding member 23 and the regulating portion 54 but the receiving portion 25 is located upstream of the light transmitting windows 40*a* and 41*a*, so that the amount of the scattered toner deposited on the light transmitting windows 40*a* and 41*a* can be considerably reduced. As a result, even in the constitution in which the toner is fed upwardly by utilizing the elastic force of the toner feeding member 23, the light transmission-type remaining toner amount detection can be performed stably with accuracy.

Incidentally, in this embodiment, the regulating portion 55 is configured to be integral with the rotation shaft 54. However, similar to Embodiment 2, the regulating portion 55 may also be formed of a flexible material.

As described hereinabove, according to the present invention, by receiving the developer falling from the developer feeding member, it is possible to suppress the amount of the scattered developer deposited on the light transmitting member. Therefore, in the present invention, it is possible to carry out the remaining developer amount detection with accuracy.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 138041/2008 filed May 27, 2008 and 109390/2009 filed Apr. 28, 2009, which are hereby incorporated by reference.

What is claimed is:

1. A developing device for use with an electrophotographic image forming apparatus, said developing device comprising:

a developer carrying member that develops an electrostatic latent image formed on an electrophotographic photosensitive member with developer;

a developer chamber provided with said developer carrying member;

a developer accommodating chamber that accommodates the developer to be supplied to said developer chamber, and comprises (a) a wall surface separating said developer accommodating chamber from said developer chamber, the wall surface being provided with an opening for permitting passing of the developer therethrough, and (b) a bottom surface;

a rotation shaft rotatably supported in said developer accommodating chamber; and a light transmitting member mounted to said developer accommodating chamber at a position upstream of the opening and downstream of the bottom surface of said developer accommodating chamber with respect to a rotational direction of said rotation shaft, said light transmitting member passing a detection light through an inside of said developer accommodating chamber in order to detect the amount of the developer in said developer accommodating chamber, wherein said rotation shaft includes:

a developer feeding member, which has flexibility and is mounted to said rotation shaft at one end thereof with respect to the direction of the radius of gyration of said rotation shaft, the developer feeding member feeding the developer while deforming in contact with an inner wall of said developer accommodating chamber at the other end thereof by rotation of said rotation shaft;

a receiving portion that receives the developer falling from said developer feeding member by the rotation of said rotation shaft, and wherein said developer carrying member is disposed above a rotational axis of said rotational shaft.

2. A device according to claim 1, wherein said light transmitting member includes a projection window through which the detection light passes into said developer accommodating chamber and a light receiving window through which the detection light having passed into said developer accommodating chamber passes, and the projection window and the light receiving window are disposed oppositely to each other along a rotational axis direction of said rotation shaft.

3. A device according to claim 1 or 2, further comprising a cleaning member provided upstream of said developer feeding member with respect to the rotational direction of said rotation shaft, the cleaning member sliding on said light transmitting member by the rotation of said rotation shaft, and wherein said cleaning member is a flexible sheet member that is mounted to said rotation shaft at one end thereof, and said cleaning member is contactable to said light transmitting member at the other end thereof.

4. A device according to claim 1, wherein an end of said receiving portion does not slide on the inner wall and said light transmitting member.

5. A device according to claim 1, wherein said receiving portion is a flexible sheet member mounted to said rotation shaft at one end thereof.

6. A process cartridge detachably mountable to a main assembly of an electrophotographic image forming apparatus, said process cartridge comprising:

an electrophotographic photosensitive member;

a developer carrying member that develops an electrostatic latent image formed on said electrophotographic photosensitive member with developer;

a developer chamber provided with said developer carrying member;

a developer accommodating chamber that accommodates the developer to be supplied to said developer chamber, and comprises (a) a wall surface separating said developer accommodating chamber from said developer chamber, the wall surface being provided with an opening for permitting passing of the developer therethrough, and (b) a bottom surface;

a rotation shaft rotatably supported in said developer accommodating chamber; and a light transmitting member mounted to said developer accommodating chamber at a position upstream of the opening and downstream of the bottom surface of said developer accommodating chamber with respect to a rotational direction of said rotation shaft, said light transmitting member passing a detection light through an inside of said developer accommodating chamber in order to detect the amount of the developer in said developer accommodating chamber, wherein said rotation shaft includes:

a developer feeding member, which has flexibility and is mounted to said rotation shaft at one end thereof with respect to the direction of the radius of gyration of said rotation shaft, the developer feeding member feeding the developer while deforming in contact with an inner wall of said developer accommodating chamber at the other end thereof by rotation of said rotation shaft; and a receiving portion that receives the developer falling from said developer feeding member by the rotation of said rotation shaft, wherein said developer carrying member is disposed above a rotational axis of said rotational shaft.

7. A cartridge according to claim 6, wherein said light transmitting member includes a projection window through which the detection light passes into said developer accommodating chamber and a light receiving window through which the detection light having passed into said developer accommodating chamber passes, and the projection window and the light receiving window are disposed oppositely to each other along a rotational axis direction of said rotation shaft.

8. A cartridge according to claim 6, further comprising a cleaning member provided upstream of said developer feeding member with respect to the rotational direction of said rotation shaft, the cleaning member sliding on said light transmitting member by the rotation of said rotation shaft, and wherein said cleaning member is a flexible sheet member that is mounted to said rotation shaft at one end thereof, and said cleaning member is contactable to said light transmitting member at the other end thereof.

9. A cartridge according to claim 6, wherein an end of said receiving portion does not slide on the inner wall and said light transmitting member.

10. A cartridge according to claim 6, wherein said receiving portion is a flexible sheet member mounted to said rotation shaft at one end thereof.

11. An electrophotographic image forming apparatus for forming an image on a recording material, said electrophotographic image forming apparatus comprising:

(i) an electrophotographic photosensitive member;

(ii) a developing device comprising:

a developer carrying member that develops an electrostatic latent image formed on an electrophotographic photosensitive member with developer;

a developer chamber provided with said developer carrying member;

a developer accommodating chamber that accommodates the developer to be supplied to said developer chamber, and comprises (a) a wall surface separating said developer accommodating chamber from said developer chamber, the wall surface being provided with an opening for permitting passing of the developer therethrough, and (b) a bottom surface;

a rotation shaft rotatably supported in said developer accommodating chamber; and a light transmitting member mounted to said developer accommodating chamber at a position upstream of the opening and downstream of the bottom surface of said developer accommodating chamber with respect to a rotational direction of said rotation shaft, said light transmitting member passing a detection light through an inside of said developer accommodating chamber in order to detect the amount of the developer in said developer accommodating chamber, wherein said rotation shaft includes:

a developer feeding member, which has flexibility and is mounted to said rotation shaft at one end thereof with respect to the direction of the radius of gyration of said rotation shaft, the developer feeding member feeding the developer while deforming in contact with an inner wall of said developer accommodating chamber at the other end thereof by rotation of said rotation shaft; and a receiving portion that receives the developer falling from said developer feeding member by the rotation of said rotation shaft, wherein said developer carrying member is disposed above a rotational axis of said rotational shaft; and (iii) feeding means for feeding the recording material.

12. An electrophotographic image forming apparatus for forming an image on a recording material, said electrophotographic image forming apparatus comprising:

(i) a process cartridge;

(ii) mounting means for detachably mounting said process cartridge, said process cartridge comprising:

an electrophotographic photosensitive member;

a developer carrying member that develops an electrostatic latent image formed on said electrophotographic photosensitive member with developer;

a developer chamber provided with said developer carrying member;

a developer accommodating chamber that accommodates the developer to be supplied to said developer chamber, and comprises (a) a wall surface separating said developer accommodating chamber from said developer chamber, the wall surface being provided with an opening for permitting passing of the developer therethrough, and (b) a bottom surface;

a rotation shaft rotatably supported in said developer accommodating chamber; and a light transmitting member mounted to said developer accommodating chamber at a position upstream of the opening and downstream of the bottom surface of said developer accommodating chamber with respect to a rotational direction of said rotation shaft, said light transmitting member passing a detection light through an inside of said developer accommodating chamber in order to detect the amount of the developer in said developer accommodating chamber, wherein said rotation shaft includes:

a developer feeding member, which has flexibility and is mounted to said rotation shaft at one end thereof with respect to the direction of the radius of gyration of said rotation shaft, the developer feeding member feeding the developer while deforming in contact with an inner wall of said developer accommodating chamber at the other end thereof by rotation of said rotation shaft; and a receiving portion that receives the developer falling from said developer feeding member by the rotation of said rotation shaft; and wherein said developer carrying member is disposed above a rotational axis of said rotational shaft; and (iii) feeding means for feeding the recording material.

13. A developing device for use with an electrophotographic image forming apparatus, said developing device comprising:

a developer carrying member that develops an electrostatic latent image formed on an electrophotographic photosensitive member with developer;

a developer chamber provided with said developer carrying member;

a developer accommodating chamber that accommodates the developer to be supplied to said developer chamber, and comprises (a) a wall surface separating said developer accommodating chamber from said developer chamber, the wall surface being provided with an opening for permitting passing of the developer therethrough, and (b) a bottom surface;

a rotation shaft rotatably supported in said developer accommodating chamber; and a light transmitting member mounted to said developer accommodating chamber at a position upstream of the opening and downstream of the bottom surface of said developer accommodating chamber with respect to a rotational direction of said rotation shaft, said light transmitting member passing a detection light through an inside of said developer accommodating chamber in order to detect the amount of the developer in said developer accommodating chamber, wherein said rotation shaft includes:

a developer feeding member, which has flexibility and is mounted to said rotation shaft at one end thereof with respect to the direction of the radius of gyration of said rotation shaft, the developer feeding member feeding the developer while deforming in contact with an inner wall of said developer accommodating chamber at the other end thereof by rotation of said rotation shaft;

a cleaning member provided upstream of said developer feeding member with respect to the rotational direction of said rotation shaft, said cleaning member sliding on said light transmitting member by the rotation of said rotation shaft; and a regulating portion provided upstream of said developer feeding member and upstream of said cleaning member with respect to a rotation direction of said rotation shaft, said regulating portion regulating movement of the developer in a downstream direction with respect to the rotational direction by falling of the developer from said developer feeding member through the rotation of said rotation shaft, and wherein said developer carrying member is disposed above a rotational axis of said rotational shaft.

14. A device according to claim 13, wherein said light transmitting member includes a projection window through which the detection light passes into said developer accommodating chamber and a light receiving window through which the detection light having passed into said developer accommodating chamber passes, and the projection window and the light receiving window are disposed oppositely to each other along a rotational axis direction of said rotation shaft.

15. A device according to claim 13, wherein said cleaning member is a flexible sheet member that is mounted to said rotation shaft at one end thereof, an said cleaning member is contactable to said light transmitting member at the other end thereof.

16. A device according to claim 13, wherein an end of said regulating portion does not slide on the inner wall and said light transmitting member.

17. A device according to claim 13, wherein said regulating portion is a flexible sheet member mounted to said rotation shaft at one end thereof.

18. A process cartridge detachably mountable to a main assembly of an electrophotographic image forming apparatus, said process cartridge comprising:

an electrophotographic photosensitive member;

a developer carrying member that develops an electrostatic latent image formed on said electrophotographic photosensitive member with developer;

a developer chamber provided with said developer carrying member;

a developer accommodating chamber that accommodates the developer to be supplied to said developer chamber, and comprises (a) a wall surface separating said developer accommodating chamber from said developer chamber, the wall surface being provided with an opening for permitting passing of the developer therethrough, and (b) a bottom surface;

a rotation shaft rotatably supported in said developer accommodating chamber; and a light transmitting member mounted to said developer accommodating chamber at a position upstream of the opening and downstream of the bottom surface of said developer accommodating chamber with respect to a rotational direction of said rotation shaft, said light transmitting member passing a detection light through an inside of said developer accommodating chamber in order to detect the amount of the developer in said developer accommodating chamber, wherein said rotation shaft includes:

a developer feeding member, which has flexibility and is mounted to said rotation shaft at one end thereof with respect to the direction of the radius of gyration of said rotation shaft, the developer feeding member feeding the developer while deforming in contact with an inner wall of said developer accommodating chamber at the other end thereof by rotation of said rotation shaft;

a cleaning member provided upstream of said developer feeding member with respect to the rotational direction of said rotation shaft, said cleaning member sliding on said light transmitting member by the rotation of said rotation shaft; and a regulating portion provided upstream of said developer feeding member and upstream of said cleaning member with respect to a rotation direction of said rotation shaft, said regulating portion regulating movement of the developer in a downstream direction with respect to the rotational direction by falling of the developer from said developer feeding member through the rotation of said rotation shaft, and wherein said developer carrying member is disposed above a rotational axis of said rotational shaft.

19. A cartridge according to claim 18, wherein said light transmitting member includes a projection window through which the detection light passes into said developer accommodating chamber and a light receiving window through which the detection light having passed into said developer accommodating chamber passes, and the projection window and the light receiving window are disposed oppositely to each other along a rotational axis direction of said rotation shaft.

20. A cartridge according to claim 18, wherein said cleaning member is a flexible sheet member that is mounted to said rotation shaft at one end thereof, and said cleaning member is contactable to said light transmitting member at the other end thereof.

21. A cartridge according to claim 18, wherein an end of said regulating portion does not slide on the inner wall and said light transmitting member.

22. A cartridge according to claim 18, wherein said regulating portion is a flexible sheet member mounted to said rotation shaft at one end thereof.

23. An electrophotographic image forming apparatus for forming an image on a recording material, said electrophotographic image forming apparatus comprising:

(i) an electrophotographic photosensitive member;

(ii) a developing device comprising:

a developer carrying member that develops an electrostatic latent image formed on said electrophotographic photosensitive member with developer;

a developer chamber provided with said developer carrying member;

a developer accommodating chamber that accommodates the developer to be supplied to said developer chamber, and comprises (a) a wall surface separating said developer accommodating chamber from said developer chamber, the wall surface being provided with an opening for permitting passing of the developer therethrough, and (b) a bottom surface;

a rotation shaft rotatably supported in said developer accommodating chamber; and a light transmitting member mounted to said developer accommodating chamber at a position upstream of the opening and downstream of the bottom surface of said developer accommodating chamber with respect to a rotational direction of said rotation shaft, said light transmitting member passing a detection light through an inside of said developer accommodating chamber in order to detect the amount of the developer in said developer accommodating chamber, wherein said rotation shaft includes:

a developer feeding member, which has flexibility and is mounted to said rotation shaft at one end thereof with respect to the direction of the radius of gyration of said rotation shaft, the developer feeding member feeding the developer while deforming in contact with an inner wall of said developer accommodating chamber at the other end thereof by rotation of said rotation shaft;

a cleaning member provided upstream of said developer feeding member with respect to the rotational direction of said rotation shaft, said cleaning member sliding on said light transmitting member by the rotation of said rotation shaft; and a regulating portion provided upstream of said developer feeding member and upstream of said cleaning member with respect to a rotation direction of said rotation shaft, said regulating portion regulating movement of the developer in a downstream direction with respect to the rotational direction by falling of the developer from said developer feeding member through the rotation of said rotation shaft, and wherein said developer carrying member is disposed above a rotational axis of said rotational shaft; and (iii) feeding means for feeding the recording material.

24. An electrophotographic image forming apparatus for forming an image on a recording material, said electrophotographic image forming apparatus comprising:

(i) a process cartridge;

(ii) mounting means for detachably mounting a process cartridge, said process cartridge comprising:

an electrophotographic photosensitive member;

a developer carrying member that develops an electrostatic latent image formed on said electrophotographic photosensitive member with developer;

a developer chamber provided with said developer carrying member;

a developer accommodating chamber that accommodates the developer to be supplied to said developer chamber, and comprises (a) a wall surface separating said developer accommodating chamber from said developer chamber, the wall surface being provided with an opening for permitting passing of the developer therethrough, and (b) a bottom surface;

a rotation shaft rotatably supported in said developer accommodating chamber; and a light transmitting member mounted to said developer accommodating chamber at a position upstream of the opening and downstream of the bottom surface of said developer accommodating chamber with respect to a rotational direction of said rotation shaft, said light transmitting member passing a detection light through an inside of said developer accommodating chamber in order to detect the amount of the developer in said developer accommodating chamber, wherein said rotation shaft includes:

a developer feeding member, which has flexibility and is mounted to said rotation shaft at one end thereof with respect to the direction of the radius of gyration of said rotation shaft, the developer feeding member feeding the developer while deforming in contact with an inner wall of said developer accommodating chamber at the other end thereof by rotation of said rotation shaft;

a cleaning member provided upstream of said developer feeding member with respect to the rotational direction of said rotation shaft, said cleaning member sliding on said light transmitting member by the rotation of said rotation shaft; and a regulating portion provided upstream of said developer feeding member and upstream of said cleaning member with respect to a rotation direction of said rotation shaft, said regulating portion regulating movement of the developer in a downstream direction with respect to the rotational direction by falling of the developer from said developer feeding member through the rotation of said rotation shaft, and wherein said developer carrying member is disposed above a rotational axis of said rotational shaft; and (iii) feeding means for feeding the recording material.

* * * * *